US007692522B2

(12) United States Patent
Hartinger et al.

(10) Patent No.: US 7,692,522 B2
(45) Date of Patent: Apr. 6, 2010

(54) METHOD AND DEVICE FOR THE SAFE OPERATION OF A SWITCHING DEVICE

(75) Inventors: Peter Hartinger, Bodenwöhr (DE); Norbert Mitlmeier, Ursensollen (DE); Ludwig Niebler, Laaber (DE); Fritz Pohl, Hemhofen (DE); Norbert Zimmermann, Sulzbach-Rosenberg (DE)

(73) Assignee: Siemens Aktiengesellschaft, Munich (DE)

( * ) Notice: Subject to any disclaimer, the term of this patent is extended or adjusted under 35 U.S.C. 154(b) by 132 days.

(21) Appl. No.: 11/793,697

(22) PCT Filed: Dec. 22, 2005

(86) PCT No.: PCT/EP2005/057109

§ 371 (c)(1),
(2), (4) Date: Jun. 21, 2007

(87) PCT Pub. No.: WO2006/069970

PCT Pub. Date: Jul. 6, 2006

(65) Prior Publication Data

US 2008/0036561 A1 Feb. 14, 2008

(30) Foreign Application Priority Data

Dec. 23, 2004 (DE) ..... 10 2004 062 266
Dec. 23, 2004 (DE) ..... 10 2004 062 267

(51) Int. Cl.
*H01H 67/02* (2006.01)
*H01H 3/00* (2006.01)

(52) U.S. Cl. ..... 335/131; 335/192

(58) Field of Classification Search ..... 335/331, 335/332, 192
See application file for complete search history.

(56) References Cited

U.S. PATENT DOCUMENTS 4,737,749 A * 4/1988 Held ..... 335/131

(Continued)

FOREIGN PATENT DOCUMENTS

CN 101088133 12/2007

(Continued)

OTHER PUBLICATIONS

Chinese Office Action dated Feb. 6, 2009.

*Primary Examiner*—Elvin G Enad
*Assistant Examiner*—Alexander Talpalatskiy
(74) *Attorney, Agent, or Firm*—Harness, Dickey & Pierce, P.L.C.

(57) ABSTRACT

A method and device are disclosed for safely operating a switching device with at least one main contact, which can be switched on or off, and which has contact elements and a moving contact bridge, and with at least one control magnet, which has a moving armature. During switching on and off, the armature acts upon the contact bridge whereby closing and opening the corresponding main contact. At least one embodiment of the method includes the following: a) identifying whether the moving contact bridge of the at least one main contact has surpassed an opening point after the switching off; and b) interrupting the further operation of the switching device when the opening point has not been surpassed after a predetermined period of time.

44 Claims, 14 Drawing Sheets

U.S. PATENT DOCUMENTS

| | | | | |
|---|---|---|---|---|
| 5,243,291 | A * | 9/1993 | Umemura | 324/418 |
| 5,455,733 | A * | 10/1995 | Waggamon | 361/115 |
| 5,917,394 | A * | 6/1999 | Fuchs | 335/229 |
| 6,023,110 | A * | 2/2000 | Henrion et al. | 307/125 |
| 6,411,184 | B1 * | 6/2002 | Comtois et al. | 335/106 |
| 2003/0090351 | A1 * | 5/2003 | Chen et al. | 335/132 |
| 2008/0036562 | A1 | 2/2008 | Adunka et al. | |

FOREIGN PATENT DOCUMENTS

| | | | |
|---|---|---|---|
| EP | 0 694 937 | B1 | 3/2000 |
| EP | 0 832 496 | B1 | 5/2001 |
| EP | 1 298 689 | | 4/2003 |
| EP | 1 298 689 | A2 | 4/2003 |

* cited by examiner

METHOD AND DEVICE FOR THE SAFE OPERATION OF A SWITCHING DEVICE

PRIORITY STATEMENT

This application is the national phase under 35 U.S.C. §371 of PCT International Application No. PCT/EP2005/057109 which has an International filing date of Dec. 22, 2005, which designated the United States of America and which claims priority on German Patent Application numbers 10 2004 062 266.3 filed Dec. 23, 2004, and 10 2004 062 267.1 filed Dec. 23, 2004, the entire contents of which are hereby incorporated herein by reference.

FIELD

At least one embodiment of the present invention generally relates to a method for safe operation of a switching device, and/or to a corresponding apparatus.

BACKGROUND

Switching devices, in particular, low-voltage switching devices, can be used to switch the current paths between an electrical supply device and loads and therefore to switch their operating currents. Thus, the connected loads can be connected and disconnected safely by the switching device opening and closing current paths.

An electrical low-voltage switching device, such as a contactor, a circuit breaker or a compact starter, has one or more so-called main contacts for switching of the current paths, which main contacts may be controlled by one or more control measurements. In principle, the main contacts in this case include a moving contact link and fixed contact pieces, to which the loads and the supply device are connected. An appropriate connection or disconnection signal is passed to the control magnet in order to close and open the main contacts, in response to which the armatures of these control magnets act on the moving contact links such that the contact links carry out a relative movement with respect to the fixed contact pieces and either close or open the current paths to be switched.

In order to improve the contact between the contact pieces and the contact links, appropriately designed contact surfaces are provided at points at which the two touch one another. These contact surfaces are composed of materials such as silver alloys which are fitted both to the contact link and to the contact pieces at these points and have a specific thickness.

The materials on the contact surfaces are subject to wear during every switching process. Factors which can influence this wear are:

- increasing contact erosion or contact wear as the number of connection and disconnection processes increases,
- increasing deformation,
- increasing contact corrosion as a result of arcing, or
- environmental influences such as vapors or suspended particles, etc.

In consequence, the operating currents are no longer safely switched and this can lead to current interruptions, contact heating or to contact welding.

For example, the thickness of the materials applied to the contact surfaces will decrease in particular as the contact erosion increases. In consequence, the switching distance between the contact surfaces of the contact link and the contact pieces becomes longer and in the end this reduces the contact force on closing. In consequence, the contacts will no longer close correctly as the number of switching process increases. The current interruptions resulting from this or else increased connection bouncing can then lead to contact heating and thus to increased melting of the contact material, which can then in turn lead to welding of the contact surfaces of the main contacts.

If one main contact in the switching device is worn or even welded, then the switching device can no longer safely disconnect the load. In the case of a welded contact at least the current path with the welded main contact will still actually in consequence despite the disconnection signal carry current and be live, so that the load is not completely disconnected from the supply device. Since the load therefore remains in a non-safe state, the switching device represents a potential fault source.

In consequence, the protective function can be blocked, for example in the case of compact starters according to IEC 60 947-6-2, in which an additional protection mechanism acts on the same main contacts as the control magnet during normal switching.

Fault sources such as these must therefore be avoided for safe operation of switching devices and therefore for protection of the load and of the electrical installation.

SUMMARY

At least one embodiment of the present invention identifies potential fault sources and reacts to them appropriately.

At least one embodiment of the present invention therefore makes it possible to identify and to react appropriately to contact welding during disconnection and the fact that operation of the switching device is no longer safe, with little complexity.

According to at least one embodiment of the invention, a process is carried out for this purpose during operation of a switching device, in particular during disconnection to identify whether the moving contact link of the at least one main contact has passed beyond an opening point. Further operation of the switching device is interrupted if the opening point has not been passed after a predetermined time period.

The predetermined opening point in this case corresponds to a previously determined opening movement of the contact link at which it is still just connected to the contact pieces. If an opening movement which is shorter than this predetermined opening point is then determined after disconnection, that is to say after deliberate opening of the at least one main contact, then it can be assumed that welding has occurred and that operation of this switching device is therefore not safe. If monitoring and identification are carried out during operation for the occurrence of a non-safe operating situation such as this, further operation of the switching device can be prevented in good time.

The method according to at least one embodiment of the invention and the apparatus according to at least one embodiment of the invention therefore ensure safe operation of a switching device, such as a contactor, a circuit breaker or a compact outgoer, and in particular safe operation of a three-pole switching device.

In one refinement according to at least one embodiment of the invention, the fact that the opening point has been passed is identified by measuring a current in a current path to be switched by the main contact, with the opening point not having been passed if the measured current is greater than the intended current after disconnection.

The fact that the opening point has been passed can also be identified by measuring a voltage drop across a main contact, with the opening point not having been passed if the voltage drop is less than the intended voltage drop after disconnection.

In a further refinement, the fact that the opening point has been passed is identified by measuring an inductance of the control magnet, with the opening point not having been passed if the inductance after disconnection has a value which does not correspond to the intended value after opening in comparison to correct operation.

Furthermore, the opening point can be identified by a state of device(s) which are operatively connected to the contact link, with the identified opening point not having been passed if these means remain in this state, which does not correspond to the predetermined state after opening, after disconnection. This is the case, for example, in the event of welding of at least one main contact.

In a further refinement according to at least one embodiment of the invention, an auxiliary contact is closed on connection or for connection of a control magnet, with a break contact then being closed on connection of the control magnet. A release device, which is connected in series with the switching contacts, initiates a contact breaking-open device if the auxiliary contact remains, or has remained, in the closed state on disconnection. In this case as well, it can be assumed that at least one of the main contacts has become welded or stuck.

In particular, the switching contacts are designed such that, during connection, the auxiliary contact closes before the break contact, and such that, during disconnection, the break contact closes before the auxiliary contact.

In a further refinement according to at least one embodiment of the invention during a switching operation, any magnetic flux change in the magnetic circuit of the control magnet is measured, with the opening point being passed over when, during disconnection of the control magnet, the magnetic flux change has exceeded a predetermined comparison value. The magnetic flux change is preferably measured by way of an induction coil. According to a further refinement according to at least one embodiment of the invention, the electrical supply for an evaluation and control unit for the switching device is maintained by means of an electrical energy-storage element, for example, by way of a capacitor, an electrical coil or a battery, for a minimum time, in order to identify by measurement the presence of a welded main contact and in order, if necessary, to actuate or to release a contact-breaking open device and/or a latching mechanism.

In particular, in the presence of a switching command, the control magnet is energized to operate at least one main contact only once the electrical-energy storage element has reached a minimum state of charge. The minimum state of charge is in this case set such that, after disconnection of the controller and in particular after removal of the switching voltage for electrical energizing of the control magnet of the switching device, the evaluation and control unit is electrically supplied and, if required, can still start the initiation process.

In a further refinement of at least one embodiment of the invention, when the control magnet is in the connected state, a release device is actively held in an energized state in order to prevent the initiation of a contact breaking-open means. During disconnection, the release device and the control magnet are de-energized with an armature or a component of the control magnet which is mechanically operatively connected to the armature, preventing the initiation of the release device.

It is thus possible, for example, for the release device to prevent relief of the load on a prestressed spring in a spring energy store. In this case, the release device also has a resetting device, such as a return spring, which, after removal of the power supply for maintenance of the actively energized state, changes this safely to a passive de-energized state. The energy released by the resetting device then releases the stored energy, which is many times greater, in the contact breaking-open device. This stored energy is converted after being released to a mechanical impulse which, in the end, breaks open the welded main contact.

The release device is de-energized at a time before the control magnet during connection. Furthermore, the control magnet is de-energized at a time before the release device during disconnection. The release device is preferably a solenoid or a plunger-type magnet. The contact breaking-open means in particular has a spring energy store such as a cylindrical compression spring.

Furthermore, further switching operation is interrupted by opening a switching element which is arranged in series with the main contact in the current path.

Finally, further switching operation is interrupted by interrupting at least one control line for controlling the control magnet.

Further advantageous embodiments and preferred developments of embodiments the invention can be found in the disclosure below.

The method for determining the remaining life of switching contacts may in this case include on the one hand time detection of predetermined discrete positions of the magnet armature of the control magnet or else components which are operatively connected to the armature, and determination of the speed and mean acceleration of the armature or of this component on which the position measurement is carried out. On the other hand, it may include measurement of the connection times of the switching contacts during their closing movement.

At least four times are therefore detected in order to determine the remaining life, one of which represents the contact closing time and the others of which represent the position times of one or more position sensors. At least two of these times may be times for two closely adjacent positions, from which a value can then be derived for the speed of the moving component.

Since the component being monitored in general carries out an accelerated movement in the connection process, a mean value of a constant acceleration is determined for at least one time interval in addition to this speed value determined in this way. The position of the closing contact at the contact closing time can be determined by a simple mathematical relationship from the determined values of the speed and acceleration and from the relative positions of the position sensors with respect to one another and their position times. This position can then be used to determine whether the moving contact link of the at least one main contact has, or has not, in particular, passed an opening point after disconnection. If this opening point has not been reached after a predetermined time period, then further operation of the switching device is interrupted.

For switching devices whose speed can be controlled, in particular contactors, which include a magnetic drive which can be controlled, the speed v measured by the position sensor can thus be used in order to iteratively set the drive to a predetermined speed, or in order to restrict the speed to a predetermined interval. For this purpose, the control parameters are set in the direction of higher speed with a predetermined parameter step whenever the drive is switched on, for as long as the speed is less than the nominal value or is below the nominal range.

Alternatively, the control parameter can be set in the direction of lower speed with a predetermined parameter step whenever the drive is switched on, provided that the speed is higher than the nominal value, or is above the nominal range. Thus, the contacts close at the predetermined speed, once the speed setting has been reached.

A further option according to at least one embodiment of the invention is to use a force sensor to detect the moving contact mass. This force sensor measures the force impulse which is transferred from the disconnecting drive to the moving contact. Since the rate at which the moving contact opens is approximately independent of the mass loss, this results in a moving contact impulse that is proportional to the mass and thus in a force impulse that is proportional to the mass at the force sensor. This force impulse is determined as a force/time integral over a predetermined time period after the disconnection command for the drive, and likewise decreases by about 10% when the loss of material is, for example, 10%. The minimum value of the remaining mass of contact material is in this case linked to a corresponding minimum value of the moving contact mass, which also includes the loss of contact carrier material, based on empirical values.

If the switching device drive is a magnetic drive, the force sensor can be arranged between the magnet armature and the mechanical coupling element which opens the moving contact. The electrical auxiliary power for the force sensor and its measurement signal to the monitoring unit can be obtained via sprung contact elements.

By evaluation of the appropriate force-value signal it is therefore possible according to at least one embodiment of the invention to identify whether the moving contact link of the at least one main contact has passed an opening point, in particular during disconnection. If there is a discrepancy between the force-value signal and a predetermined force comparison value, then further operation of the switching device is interrupted after a predetermined time period.

A respective switching position of the armature, or of a component which is operatively connected to the armature, can be determined. This can be done, for example, by measuring the capacitance of a measurement capacitor. In this case, the measurement capacitor has two capacitor plates which can move relative to one another in a corresponding manner to the armature movement. The different capacitor-plate separation which results from this results in a change from the capacitance of the measurement capacitor. A constant-voltage source can be used to feed a charging-current pulse into the measurement capacitor in order to determine the increase in capacitance. In this case, the current/time integral of the charging-current pulse is proportional to the change in capacitance, and the instantaneous contact pressure can be calculated from it using the other capacitor data. If the pressure value reaches a minimum value, then the switching device is rendered inoperative by the monitoring unit.

Alternatively, it is possible to use the change in capacitance to identify whether the moving contact link of the at least one main contact which is mechanically operatively connected to the armature has, in particular, passed an opening point after disconnection. In this case, the opening point can be determined by calculation from the capacitance change and from the time value which is required in order to charge the measurement capacitor. If this time value exceeds a predetermined value, then the measurement-capacitor plate separation must be very small, and it can be assumed that the armature and the contact link connected to it have no longer opened. In this case, it can be assumed that at least one main contact has become welded. Further operation of the switching device is then interrupted.

During disconnection, the contact opening speed v is sensitivity dependent on the contact pressure D, since, for example, in the case of a magnetic drive, the magnet armature and the mechanical components coupled to it are moved from the rest position (closed position) with an approximately constant acceleration b. The speed at which the drive meets the moving contact is obtained from the relationship:

$$v=\sqrt{(2\ Db)} \text{ and therefore approximately } v\sim\sqrt{D}.$$

The speed can be detected by the measurement capacitor as described above. Since the opening movement of the magnet armature results in a decrease in the capacitor-plate separation, and this leads to a current i from the constant-voltage source U to the measurement capacitor, the contact pressure D is driven by the relationship:

$$t=t\ddot{o}, \text{ where } t\ddot{o} \text{ is the time of the opening impulse on the moving contact.}$$

The contact pressure D can therefore be determined using the following equation:

$$D=i(t)^2*(2b)^{-1}*(d^2/\epsilon AU)^2,$$

from which, once again approximately, $D\sim i(t)^2$ and thus, $\sim imax^2$.

The equation in this case includes the armature acceleration b, the plate separation d at the time of the opening impulse, the plate area A, the constant voltage U and the capacitor current imax at the time tö. If $imax^2$ falls below a predetermined minimum value, then the switching device is rendered inoperative by the monitoring unit.

In all cases in which the monitoring unit renders the switching device inoperative, the measurement variable supplying the decision criterion may be averaged in advance over a predetermined number of measurements.

Owing to the dominant moving mass of the switching device drive (magnet armature), the closing speed of the moving contact is virtually independent of the wear-dependent mass loss of the moving contact. The closing speed is therefore always the same, when the other conditions are the same. However, the closing speed will increase as the contact pressure decreases, since the magnetic forces with a small armature air gap reach a considerable magnitude and considerably accelerate the armature.

The mass change of the moving contact plays a role in the spring-and-mass system of the moving contact mass and the contact force in the event of contact bouncing and can be determined approximately by time measurement of the bouncing process. The possible decrease in the contact force with contact erosion can be taken into account in the evaluation of the contact bouncing.

On the assumption that a specific proportion a of the kinetic energy is available for lifting the contact on the first bounce the contact lifting speed $V_{K,A}$ is obtained from the contact closing speed $V_{K,S}$ as follows:

$$V_{K,A}=V_{K,S}*(\alpha)^{-0.5},$$

and from the impulse relationship for the contact mass $m_K$ $$m_K * v_{K,A} = F_K * T/2 \text{ and}$$

$$\Delta m_K = \Delta T * F_K / (2 * V_{K,S} * (\alpha)^{-0.5})$$

and therefore approximately $\Delta m_K \sim \Delta T$.

$F_K$ is in this case the contact force and T is the time for which the contact was lifted on the first bounce.

Random fluctuations can be adequately suppressed, and a representative lifting duration determined, by averaging over a predetermined number of measured bounce times. The contact voltage signal after the first closing of the contacts can be evaluated for the time measurement.

The instantaneous value of the contact closing speed $V_{K,S}$ is used for more accurate evaluation of the mass loss $\Delta m_K$. The current flying out of the constant-voltage source U at the contact closing time t=ts into the measurement capacitor is:

$$i(t) = -(\epsilon AU/d(t)^2) * v(t).$$

Since d(t) at the time ts is governed by the thickness d of the insulating layer between the capacitor plate, this means that $v_{K,S} = v(ts)$.

The armature closing speed v of the magnetic drive after the contacts touch depends in a sensitive manner on the contact pressure D, since ever greater magnetic forces act on the magnet armature as the armature air gap becomes smaller. The value of the armature closing speed $v_{K,S}$ at the time ts at which the contacts touch can be used as a rough measure of the contact wear. If v(ts) exceeds a predetermined value, then this is equated with the minimum pressure being reached. The speed (magnitude) is determined using a suitable measurement capacitor, as described above, specifically by:

$$|v_{K,S}| = |v(tS)| = |i(ts) * (\epsilon AU/d(t)^2|$$

BRIEF DESCRIPTION OF THE DRAWINGS

Advantageous and example embodiments of the invention will be described in more detail in the following text with reference to the following figures in which.

DETAILED DESCRIPTION OF THE EXAMPLE EMBODIMENTS

Figure 1:
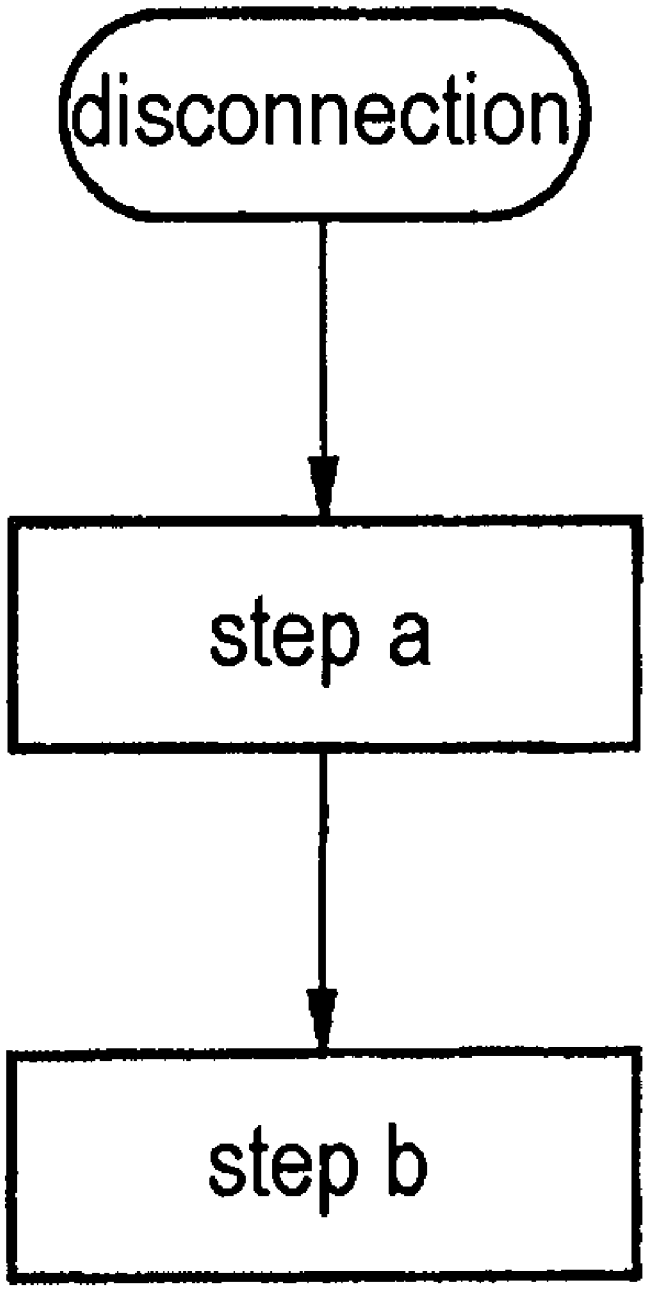
FIG. 1 shows a simplified flowchart of the method according to an embodiment of the invention.

As illustrated in FIG. 1, the two following steps are essentially carried out after a disconnection signal in the method according to an embodiment of the invention:

Step a) identification of whether the moving contact link of the at least one main contact has passed beyond an opening point after disconnection, Step b) interruption of further operation of the switching device if the opening point has not been passed after a predetermined time period.

A check is therefore carried out after correct disconnection, that is to say in particular, after a disconnection signal for opening the three main contacts with a three-pole switching device, to determine whether all of the main contacts in the switching device have been opened. According to an embodiment of the invention this has been done by checking whether the moving contact links have traveled through a specific opening distance during opening, which distance is greater than an opening point which is determined in advance, and is therefore predetermined. If the identified opening distance of one of the contact links is still below the opening point even after a time period, likewise defined in advance, after opening has also elapsed, then it can be assumed that contact welding has taken place, so that further operation of the switching device must be interrupted.

The OFF position can be checked during each switching process, for example, by way of a positively-guided contact connected within the control current circuit or via current measurement apparatuses, for example, by way of current transformers. By way of example, the check can also be carried out optically, visually, magnetically, inductively or capacitively. The evaluation and control are preferably carried out by way of an electronic control unit, for example by a microcontroller, with a check being carried out after or during the disconnection process to determine whether the current paths have been opened or whether current is still flowing at the contact point after disconnection.

If a fault situation such as this has occurred, then further operation can be interrupted, for example, by opening a redundant further switching element within the appliance, connected in series with the main contacts. The switching element then disconnects the load from the supply device, irrespective of whether the main contacts are open or closed. Since the switching element can no longer close without problems, further operation of the switching device is safely suppressed. As an alternative to opening of this additional switching element, the drive for the control magnet can also be interrupted and thus blocked, until it is reset, in the event of a fault. In addition, an appropriately powerful force store within the appliance can be initiated, acting on the welded main contact or contacts such that they are again broken open, and are thus opened.

Figure 2:
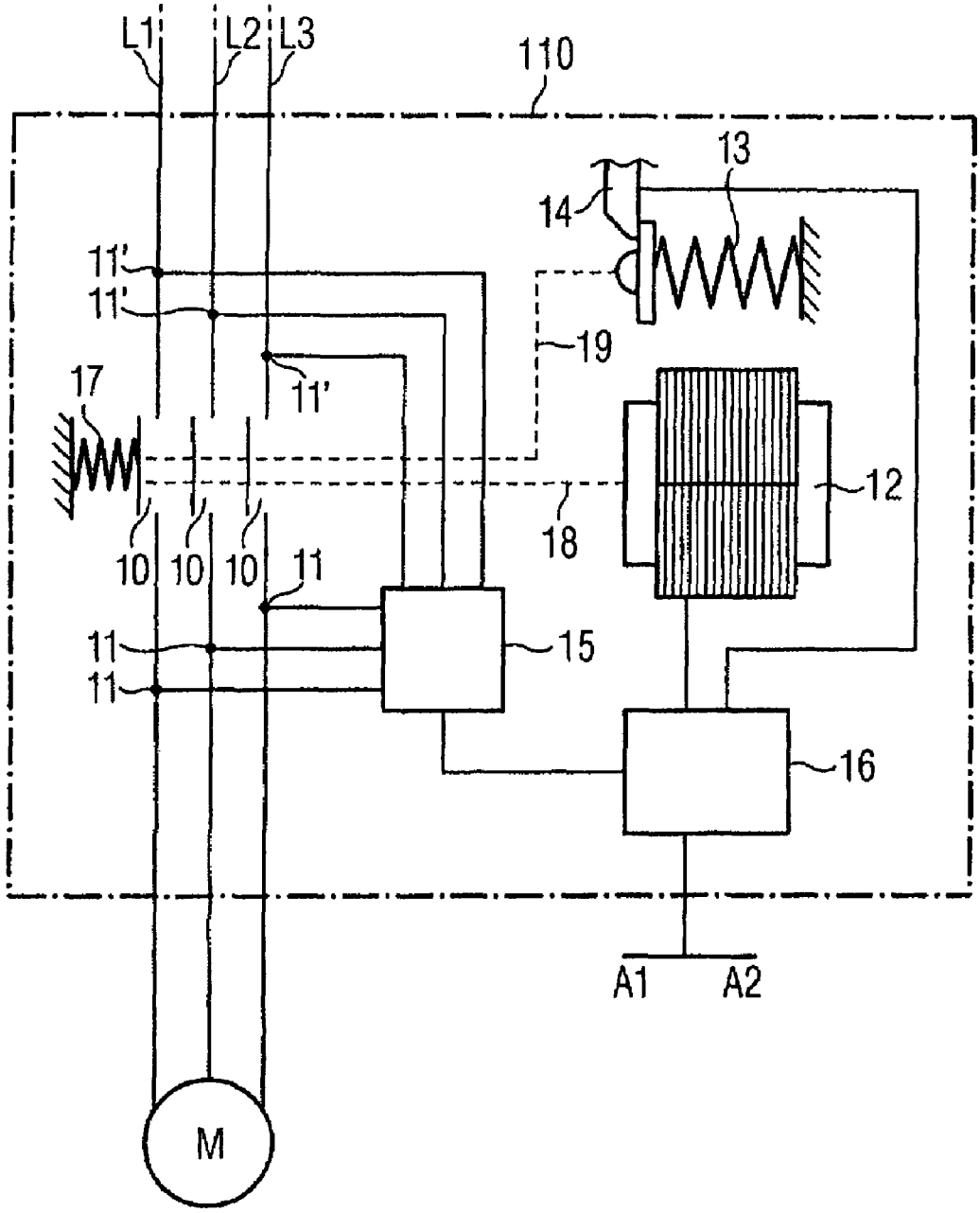
FIG. 2 shows a first embodiment of the apparatus according to the invention.

FIG. 2 shows, schematically, a first exemplary embodiment of a switching device 110 with the apparatus according to an embodiment of the invention. The connection and disconnection control signals for connection and disconnection of the main contacts 10 are applied to the control magnet 12 via terminals A1 and A2 and via a control device 16. During disconnection, the control magnet, which is used as an electromagnetic drive 12 for the main contacts 10 is de-energized via the control device 16. In this case, a force acts via the connection 18 on the contact links, against the contact load spring 17. The main contacts 10 are opened in this way and the load M is thus disconnected from the supply device in this case indicated by the three lines L1-L3.

Once the control magnet 12 has been de-energized, the evaluation device 15 also uses the electrodes 11 and 11' to carry out a check as to whether the contact links have passed the predetermined opening point. In the present example embodiment, in order to measure any voltage drop across the main contacts 10, two electrodes 11 and 11' are in each case provided for this purpose for each current path L1-L3, to be precise with one of them being provided upstream of the main contact 10, and one downstream from the main contact 10. According to an embodiment of the invention, after the disconnection of the main contacts 10 by the evaluation device 15, a voltage check of the main contacts 10 is carried out via the electrodes 11 and 11'. If the voltage drop at one of the main contacts 10 is too low, this is an indication that this contact has not opened far enough. Thus, the opening movement traveled through by the contact link during disconnection is not greater than the predetermined value, and it is highly probable that welding has occurred.

If an excessively small opening movement is still identified after a predetermined time period, for example of 100 ms, after initiation of the disconnection signal, it is necessary to ensure that further operation of the switching device 110 is interrupted. In the present example embodiment, the evaluation device 15 is connected for this purpose via a connection, which is not shown in any more detail, to the control device 16. When the evaluation device 15 now identifies a fault situation such as this, this situation is signaled to the control device 16 in response to which it interrupts at least one of the control lines.

In addition, in the present example embodiment, an initiation mechanism 14 is activated, and unlatches a spring force energy store 13. Spring force energy stores 13 such as these may in fact, for example, be latching mechanisms as known from circuit breakers or compact starters. A latching mechanism such as this then uses a mechanical operative connection 19 to apply a high force to the main contacts 10, which have not been opened, of the switching points of the switching device 110, in order to break open the welded main contacts 10.

In order to break them open in this case, the force from the spring energy store 13 must be set to be appropriately large. The spring energy store 13 then either remains in the unlatched position and can no longer be reset or the spring energy store 13 has a mechanism by which the spring 13 can be tensioned again, and the initiation mechanism 14 can be latched in place again. Since the mechanism 13 or 14 can be reset only manually, a user is therefore made aware of the fault situation and must react to it appropriately, for example by replacement of the switching device 110.

In a further example embodiment, which is not illustrated in any more detail, it is also possible to provide only one current sensor per current path. The current measurement in each of the current paths is then used to identify whether the opening point has been passed after disconnection. If it is found from the current measurement that the opening point has not been passed, further operation of the switching device is interrupted.

Figure 3:
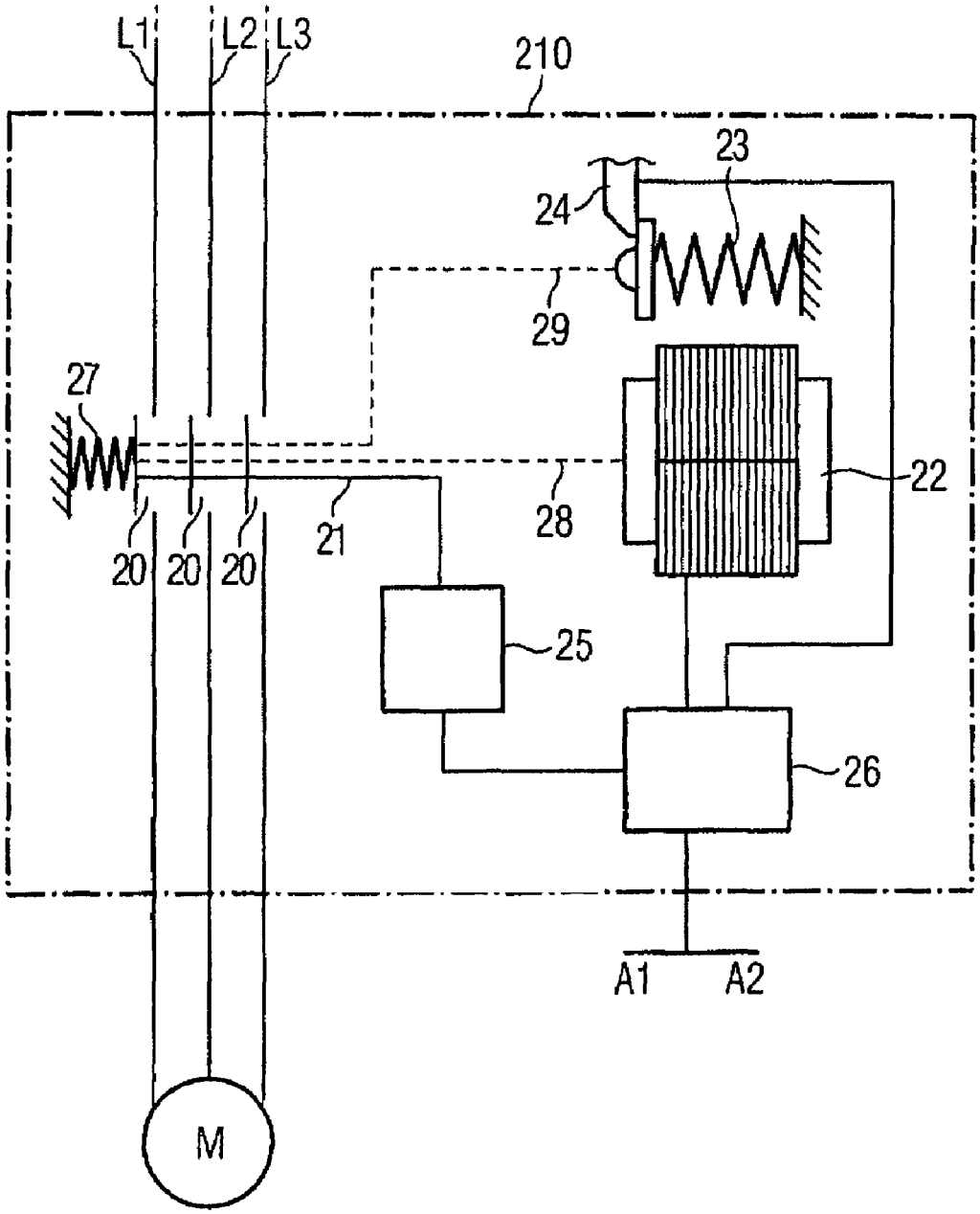
FIG. 3 shows a second embodiment of the apparatus according to the invention.

FIG. 3 shows, schematically, a second example embodiment of the apparatus according to the invention, in which the opening movement of the contact links of the switching points 20 to be identified is checked directly by the evaluation device 25. By way of example, this can be done by appropriate device(s) 21 although these are not illustrated in any more detail in FIG. 3. For example, switching monitoring means can be provided which are changed to a first state when the main contacts 20 are closed during connection and remain in this first state even after disconnection, when at least one of the main contacts 20 has been welded.

In this case, it is assumed that the identified opening movement is less than the predetermined value if these means 21 remain in this first state after disconnection, with this first state not corresponding to the predetermined state after opening.

An inductance measurement directly adjacent to the coil of the control magnet would also be feasible as a further example embodiment which is not illustrated in any more detail, for identification of the opening movement of the main contacts. The control magnet has a different inductance in the normal connected state than in the disconnected state. If this inductance of the disconnected state is not reached after disconnection, it is assumed that the opening point has not been passed, and the switching device is disconnected.

Figure 4:
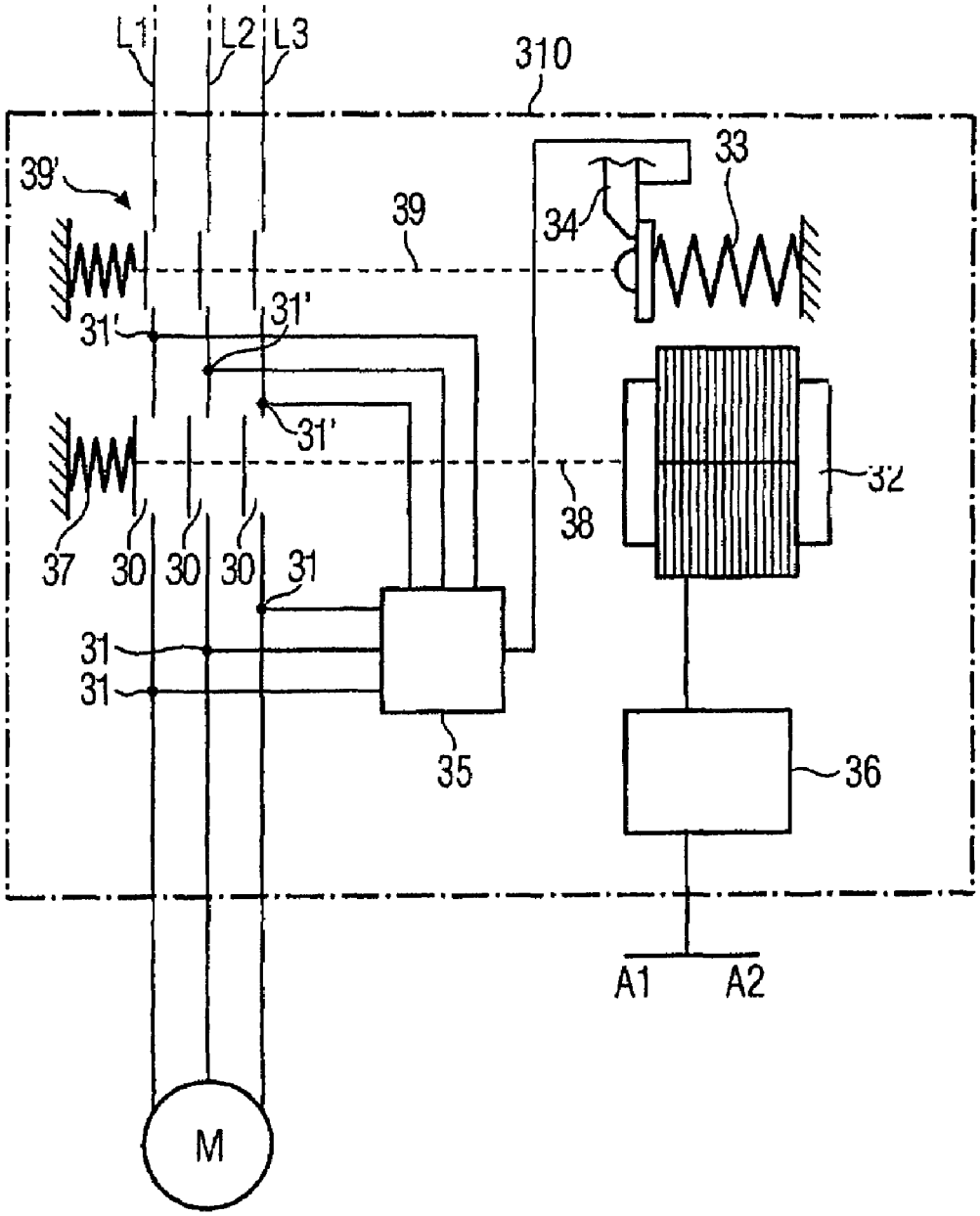
FIG. 4 shows a third embodiment of the apparatus according to the invention.
Figure 5:
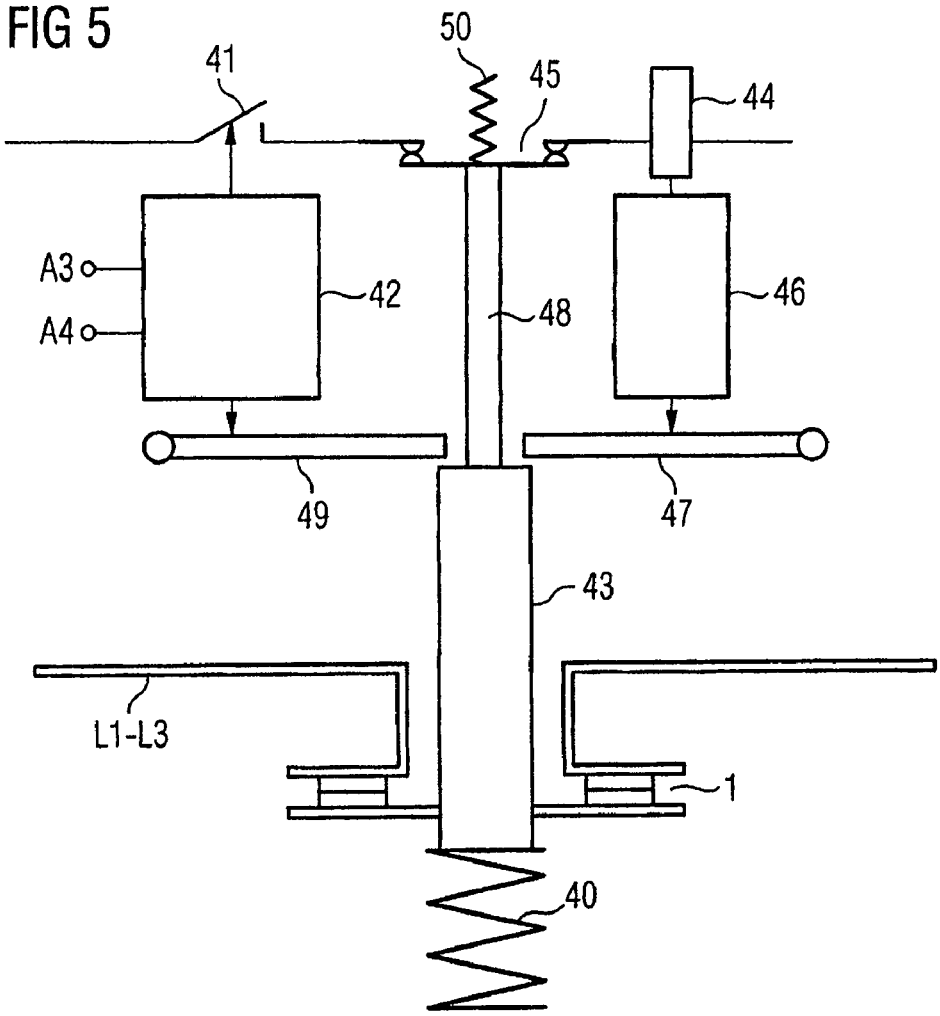
FIG. 5 shows a fourth embodiment of the apparatus according to the invention.

FIG. 4 shows a third example embodiment of the apparatus according to the invention. In this case a further switching element 39' is provided for interruption of further operation in the event of a fault, and is arranged in series with the main contacts 30, which carry out the actual switching process, in the individual current paths L1-L3. If one of the main contacts 30 becomes welded, the evaluation device 35 uses the electrodes 31 and 31' to identify that the voltage drop on this main contact 30 is excessively low. In consequence, the evaluation device 35 activates an initiation mechanism 34 and thus unlatches a spring force energy store 33. This spring force energy store 33 acts on the switching element 39' via the operative connection 39 and opens it. The current paths L1-L3 are therefore safely interrupted, irrespective of whether the main contacts 30 have been opened or are still closed, and further operation of the switching device 310 is prevented. FIG. 5 shows a fourth embodiment of the apparatus according to the invention. The apparatus has an auxiliary contact as a switching monitoring device 45 which is connected in series with a break contact 41 of a control magnet 42, or of the electromagnetic drive 42. The break contact 41 is opened as shown during connection, that is to say when the control magnet 42 is energized. Furthermore, an actuator 44 is connected in series with the break contact 41 and the auxiliary contact 45 and can initiate a breaking-open device 46 for example, a force store, or, as shown in FIG. 5, a latching mechanism in the energized or live state.

The control magnet 42 uses a drive lever 49 to operate a contact slide 43 which can open and close the main contacts 1, with the main contacts 1 being closed during normal operation, in which a contact load spring 40 closes the main contact 1, when the control magnet 42 is in the energized state. The auxiliary contact 45 is mechanically connected to the main contacts 1 by way of an auxiliary contact slide 48 and the contact slide 43, so that the switching state of the main contact 1 is "mirrored" on to the auxiliary contact 45 via them, that is to say it is transferred to the auxiliary contact 45. In this case, the mechanical connection is made such that the auxiliary contact 45 is also closed, or remains closed, if at least one main contact 1 is welded.

According to an embodiment of the invention, the switching monitoring device 45 is changed to a first state when the main contacts 1 are closed during connection of the apparatus. The break contact 41 is opened. During disconnection the break contact 41 is closed and the switching monitoring device 45 is opened. In this case, the switching monitoring device 45 remains in this first state after disconnection, if at least one of the main contacts 1 is welded.

If one of the main contacts 1 is now welded after disconnection, then the break contact 41 is closed. Further, the auxiliary contact 45 is also closed at the same time since one of the main contacts 1 is closed. This occurs despite the disconnection command. Current can now be applied to the actuator 44 via these two closed contacts 41, 45. By way of example, the actuator 44 may be a solenoid, which releases the breaking-open device 46 such as a spring energy store, when energized with current, and initiates the latching mechanism 46. A breaking-open force can thus be applied to the welded main contact 1 via the latching mechanism lever 47 and the contact slide 43, so that the weld is broken open, and the relevant load can thus be disconnected.

Since the switching voltage is normally "removed" during disconnection, that is to say the switching voltage for the electrical supply in particular for the control magnet is interrupted, it is advantageous for the switching voltage to be buffered by way of an electrical energy-storage element, for example, a capacitor. The capacitor voltage can, in this case, be isolated from the switching voltage by way of a diode.

The switching contacts 41, 45 are designed such that the auxiliary contact 45 closes during disconnection after the break contact 41 has opened and such that the break contact 41 closes during disconnection after the auxiliary contact 45 has opened. Without this special configuration of the timing of the switching delay of the switching contacts 41, 45, it is possible for both switching contacts 41, 45 to be closed at the same time, even if only briefly, during normal switching operation. The effect of this brief switching state, which in the end would lead to inadvertent initiation of the contact breaking-open device 46, can be prevented by time-filtering or smoothing of the electrical initiation signal which is passed through the two closed switching contacts 41, 45. This can be done, for example, by way of an inductor, which is connected in series with the switching contacts 41, 46, or by way of a capacitor.

Alternatively, on connection or for connection of a control magnet 42, a corresponding auxiliary contact can be opened and on connection of the control magnet 42 a make contact, not illustrated in any more detail, can be closed. A release device initiates a contact breaking-open device 46 when the auxiliary contact remains or has remained in the open state during disconnection, by evaluation of the respectively open switching state of said switching contacts.

The switching contacts are preferably designed such that the auxiliary contact opened during connection after the make contact has closed, and such that the make contact opens during disconnection after the auxiliary contact has closed.

The switching contacts may, for example, be connected in parallel, in which case an initiation signal for the release means can be produced in the event of a fault, that is to say if both switching contacts are open. The initiation signal may be produced, for example, by way of a control unit that is already provided.

Figure 6:
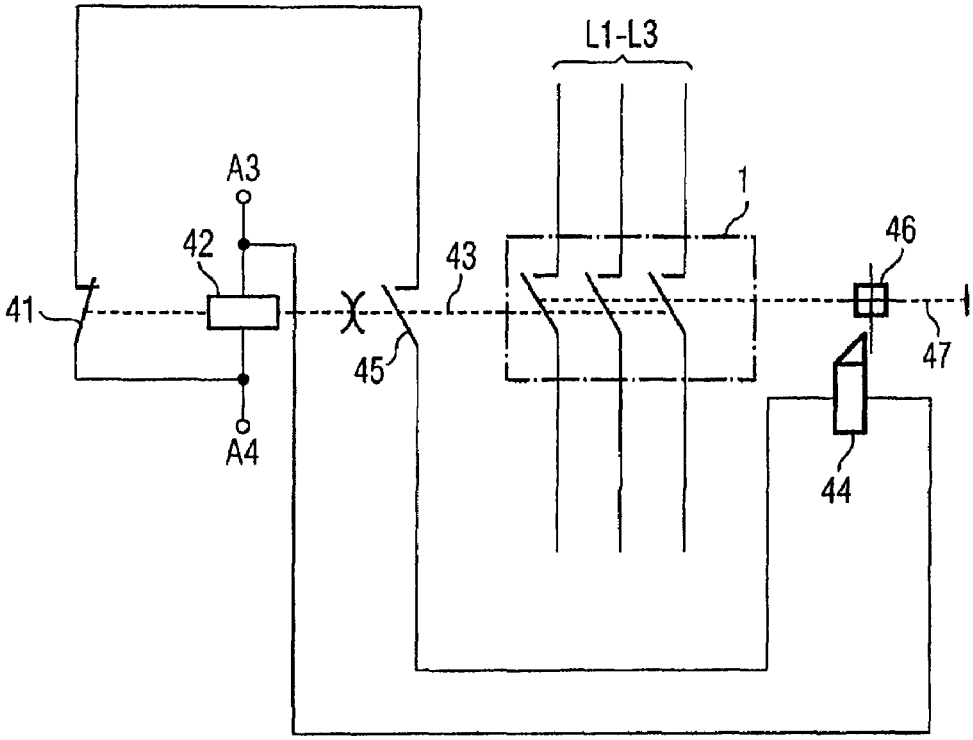
FIG. 6 shows an electrical outline circuit diagram associated with the fourth embodiment.

FIG. 6 shows an electrical outline circuit diagram associated with the fourth embodiment, shown in FIG. 5. By way of example, the three main contacts 1 are shown in the central part of FIG. 6 and are operated by way of the contact slide 43, by the control magnet 42 and by the latching mechanism 46. The series circuit including the break contact 41, the switching monitoring device 45 and the actuator 44 for releasing the switching mechanism 46 is illustrated in parallel with two connecting terminals A3 and A4, via which current can be supplied to a field coil for the control magnet 42.

If a switching voltage for connection of the apparatus is now applied to the terminals A3 and A4, then a current flows through the field coil of the control magnet 42 in order to close the main contact 1. However, in the event of a fault, that is to say if the main contact 1 is welded, the auxiliary contact 44 and/or the switching monitoring device also in fact remain/remains closed, so that the actuator 44 can now be supplied with current in order to release the latching mechanism 46.

In this case, the switching voltage applied to the terminals A3, A4 is used to supply power to the actuator 44. An apparatus of this type is, so to speak, inherently safe to the end of its life and achieves a safe switching state.

The switching apparatus can be used particularly advantageously in a compact starter, in which both the contact opening during correct closure and disconnection in the event of overcurrent are carried out only by way of a main contact arrangement.

Figure 7:
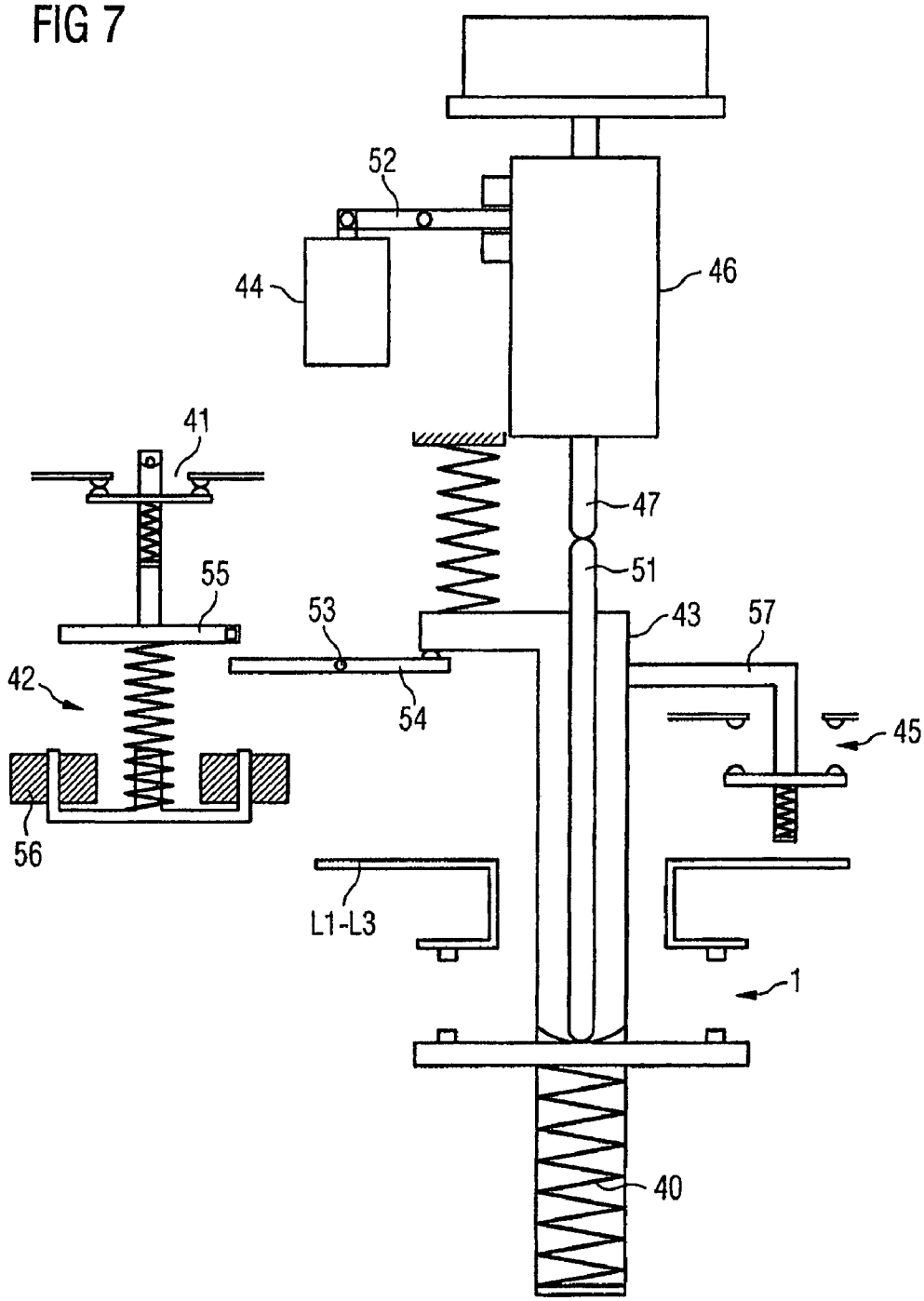
FIG. 7 shows a fifth embodiment of the apparatus according to the invention, in detail.

FIG. 7 shows a fifth embodiment of the apparatus according to an embodiment of the invention, in detail. The upper part of FIG. 7 shows a latching mechanism 46 with an integrated spring energy store as the force element for breaking open a welded main contact 1. The combined latching mechanism 46 acts directly on the moving contact link, when it is initiated, via, for example, two plungers 47, 51 which are mechanically operatively connected to one another. A welded main contact 1 can thus be broken open.

An actuator 44, as the initiation unit, is connected to the latching mechanism 46 by means of a lever 52 which, for example, is mounted such that it can rotate. The actuator 44 is, for example, a plunger-type armature or a solenoid. The actuator 44 is supplied with current for initiation. This is done in an analogous manner to that for the apparatus shown in FIG. 5 and FIG. 6. That is to say, when the release device 45 and/or the auxiliary contact and the break contact 41 of the control magnet 42 are closed for correct switching of the switching device.

In this case, the actuator 44 is supplied with current via the voltage applied to the field coil 56 of the control magnet 42. The control magnet 42 can be seen in the left-hand part of FIG. 7. On connection, the armature 55 of the control magnet 42 is attracted, with the armature 55 then operating a drive lever 54 which is mounted such that it can rotate 53.

During normal operation, this operation moves the contact slide 43 "upwards" so that the main contacts 1 can be closed by way of the spring force of the contact load spring 40. The spring force of the contact load spring 40 is in this case designed such that the force which is released on initiation of the latching mechanism 46 with the integrated force element is considerably greater, in order to make it possible for the spring force of the contact load spring 40 to also overcome the breaking-open force required for the welded main contact.

In one particular embodiment the break contact 41 and the release device 45 which is in the form of a switching contact, are operated at correct times with respect to one another in order to ensure that the force element 46 is initiated safely. It is thus advantageous if, during connection, the break contact 41 is opened at a time before the closure of the release device 45 and if, during disconnection, the break contact 31 is closed at a time after the opening of the release device 45.

Figure 8:
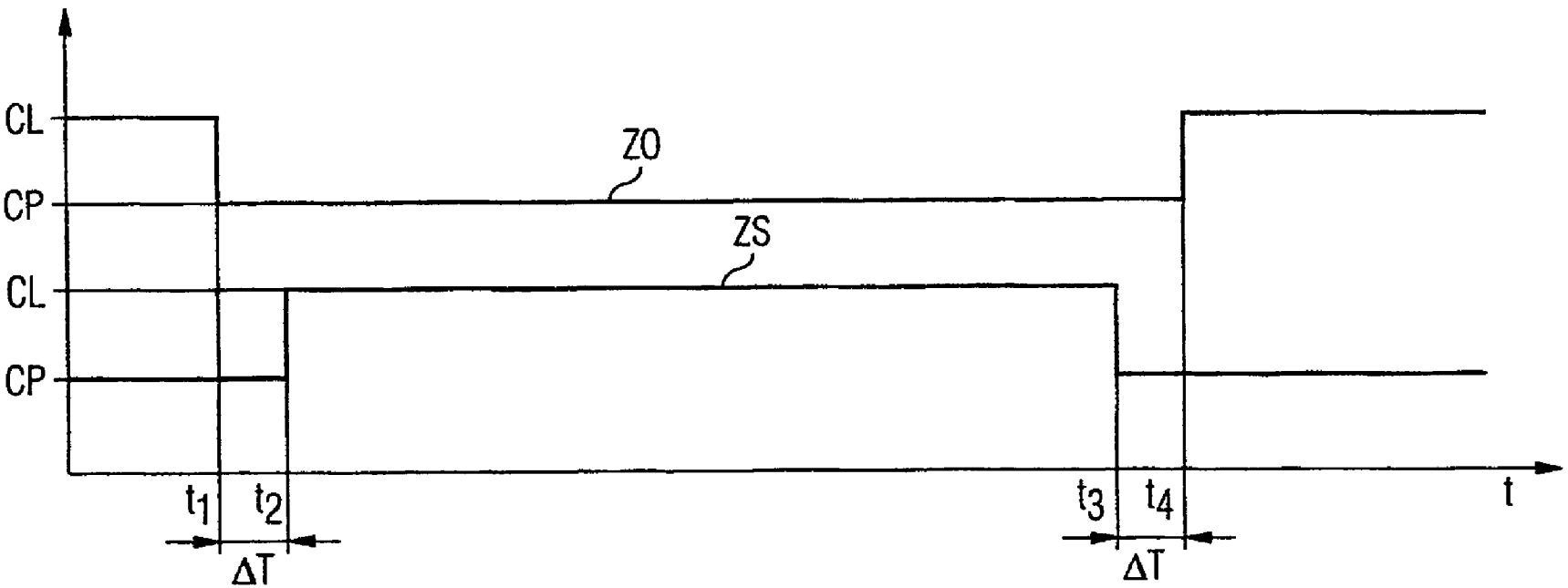
FIG. 8 shows an example of the time profile of a break contact and of a make contact, connected in series with it, as shown in FIG. 6 and FIG. 7.

This is illustrated in the next figure, FIG. 8, where ZO denotes the time profile of the break contact 41 and ZS denotes the time profile of the release device 45, which is in the form of a make contact. The reference symbol CL denotes the closed state, and the reference symbol OP, the open state, of the relevant switching contacts 41, 45. ΔT denotes the time offset between the switching flanks of the time profiles ZO and ZS, by way of example. This deliberate time delay between switching actions means that there is no need for the filter and smoothing elements required in the figure description relating to FIG. 5.

Alternatively, the break contact may also be in the form of a make contact, and the release device may be in the form of a break contact. During correct operation of the apparatus, the two switches 41 and 45 should preferably have opposite contact positions both in the connected steady state and in the disconnected steady state, that is to say, the switches 41, 45 are "open/closed" or "closed/open". This can be achieved, for example, mechanically by way of damper or electrically by means of electrical delay elements, which have different time constants for connection and disconnection.

Furthermore, the switching voltage, which is applied to the electrical connections A3 and A4 to energize the field coil 56 of the control magnet 42 for connection and disconnection of the switching device, can be buffered via a diode for voltage decoupling and via a downstream capacitor. In consequence, a sufficient amount of electrical energy is available to initiate the force element 46 and/or the latching mechanism 46 in the absence of the switching voltage in order to disconnect the apparatus in the event of a fault.

Figure 9:
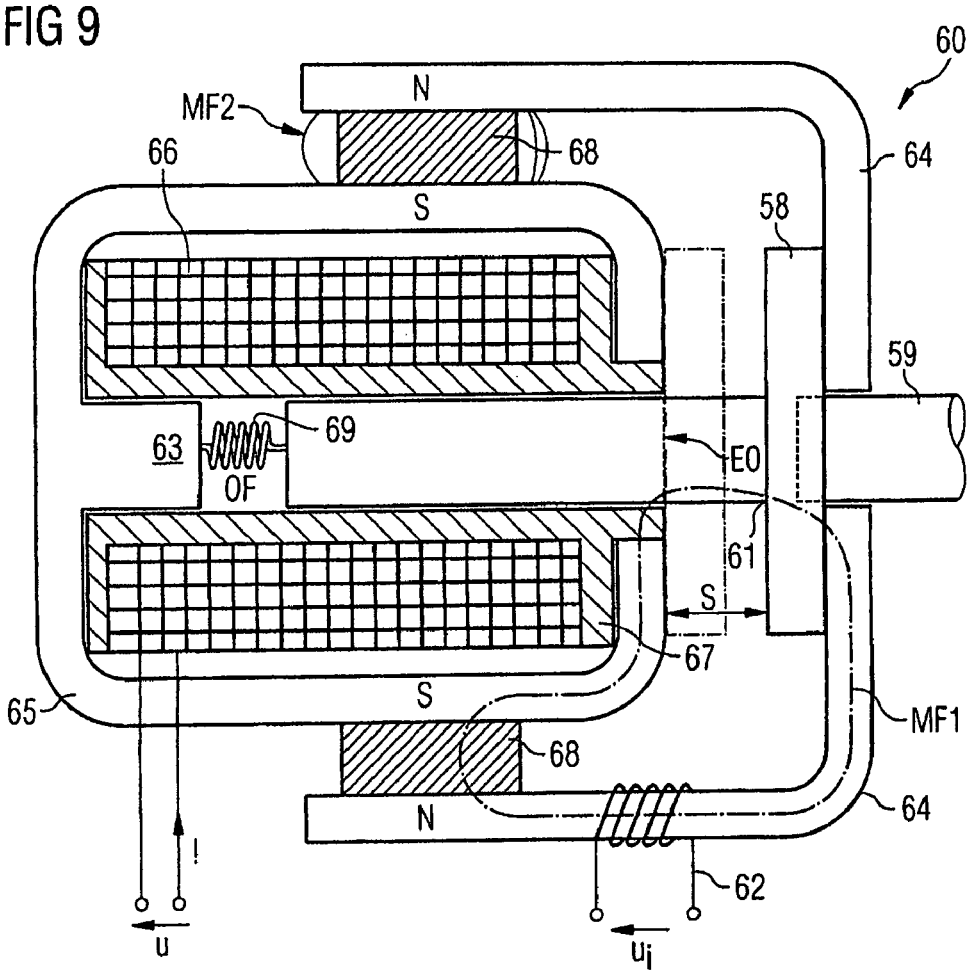
FIG. 9 shows a section image through one example embodiment of the apparatus according to the invention with an electromagnetic drive, assisted by a permanent magnet, and a measurement coil.

FIG. 9 shows a cross section through one example embodiment of the apparatus according to an embodiment of the invention, having an electromagnetic drive 60 assisted by a permanent magnet 68.

In this case the upper half shows the magnetic flux in the electromagnetic drive 60 in the ON state (see the stop plate 58 shown as represented by dashed lines). In contrast, the lower part of FIG. 9 shows the magnetic flux in the electromagnetic drive 60 in the OFF state (see the stop plate 58 as represented by solid lines).

A field coil 66 is shown in the centre of the figure, and is wound on a winding former 67. The field coil 66 has, for example, two connections for feeding in a coil current i. The reference symbol u denotes the coil voltage applied to the field coil 66 as the switching voltage. The winding former 67 and the field coil 66 form a cylindrical opening OF in which an armature 61 of the electromagnetic drive 60 can move. The armature 61 has a cylindrical bolt, which is matched to the dimensions of the cylindrical opening OF and a stop plate 58 fitted to it. The entire armature 61 is in this case produced from a ferromagnetic, and in particular soft-magnetic, material, for example, from iron. The winding former 67 and the field coil 66 are surrounded by an inner yoke 65 composed of a soft-magnetic material for magnetic guidance of the flux of the magnetic field produced by the field coil 67, with a part of the inner yoke 65 extending into the cylindrical opening OF and forming an inner pole 63 there. The magnetic field produced in this way in the end acts in the illustrated area of the cylindrical opening OF.

The electromagnetic drive 60 is assisted by at least one permanent magnet 68, thus producing a holding force, which is additionally in the OFF position of the electromagnetic drive 60, on the armature 61. The permanent magnets 68 are in this case fitted to the outside of the inner yoke 65 of the electro-magnetic drive 60. The magnetic poles of the two permanent magnets 68 are respectively annotated N and S. The permanent magnets 68 are preferably arranged along the circumference of the inner yoke 65. Instead of a multiplicity of permanent magnets 68 it is also possible to use a magnetic ring or tire, which is polarized such that a north pole N or a south pole S is formed on its inside, and a south pole S or a north pole N is formed on its outside.

Those sides of the permanent magnet 68 which point outward are, in the example shown in FIG. 9, connected to a soft-magnetic outer yoke 64 which is in the form of a pot. The outer yoke 64 likewise has a cylindrical opening, in which a contact slide 59 is guided. The contact slide 59 can be operated by means of the stop plate 58 of the armature 61, so that it is possible to operate the contact link which is connected to the contact slide 59 but not shown in any more detail.

In addition, a return spring 69 is introduced into the cylindrical opening OF between the inner pole 63 and the cylindrical bolt of the armature 61, and drives the armature 61 out of the cylindrical opening OF when no current is flowing through the field coil 66. The geometric dimensions of the cylindrical bolt of the armature 61, the outside of the inner yoke 65, and the inside of the outer yoke 64 are geometrically matched to one another such that the stop plate 58 of the armature 61 strikes the outside of the inner yoke 65 in an energized ON position, and strikes the inside of the outer yoke 64 in the de-energized state. The dashed-line representation of the stop plate 58 in this case shows the ON position of the electromagnetic drive 60.

The lower half of FIG. 9 shows the profile of the magnetic field MF1 produced by the permanent magnets 68 in the form of a dashed-dotted line for the OFF position of the electromagnetic drive 60. For comparison, the upper half of FIG. 9 shows the profile of the magnetic field MF2 caused by the permanent magnet 68 for the ON position of the electromagnetic drive 60. In the latter case, there is no path with a low magnetic reluctance for the magnetic field MF2 via the outer yoke 64, so that a magnetic stray field is necessarily formed around the respective permanent magnet 68.

The permanent-magnet restraining force on the armature 61 results in the switching process taking place suddenly, so that, in comparison to pure electromagnetic drives, the armature 61 moves immediately and with full power at the time at which it breaks free.

According to an embodiment of the invention, a change in the magnetic flux, in particular outside the field coil 66 and in particular outside the inner yoke 65 which surrounds the field core 66 of the electromagnetic drive 60 can now be identified by way of a suitable measurement device. In the example in FIG. 9, a particularly advantageous measurement coil 62 for this purpose is wound around one limb of the outer yoke 64. Instead of the measurement coil 62, it is also possible to use a magnetic-field sensor, such as a Hall sensor.

Starting from the OFF position, the magnetic flux MF1 flows through the measurement coil 62 in a non-changing form. If the armature 60 is now moved suddenly to the left, to the ON position, then the profile of the magnetic flux also changes suddenly in such a way that a stray field MF2 is also formed in the lower area, as shown in the illustration in FIG. 9, with the magnetic flux in the outer yoke 65 virtually disappearing at the same time. This dynamic change in the magnetic flux in the limb of the outer yoke 65 is evident in the form of an induced voltage $u_i$, which is produced at the connections of the measurement coil 62 and whose peak value becomes greater the faster the change in the magnetic flux.

The induced voltage $u_i$ can now be compared with a predetermined comparison value and a digital signal can be generated from the comparison result, for further signal processing.

According to an embodiment of the invention, the presence of a minimum value of the induced voltage $u_i$ identifies the fact that the moving contact link of the at least one main contact must have passed an opening point after disconnection. If, in contrast, the minimum value of the induced voltage $u_i$ is not identified after a predetermined time period or within the predetermined time period, then further operation of the switching device is interrupted. In this case, it can be assumed that contact welding must have occurred, as a result of which the armature plate 58 now does not rest completely on the inner or outer yoke 65, 64. The induced voltage $u_i$ produced is correspondingly less.

Figure 10:
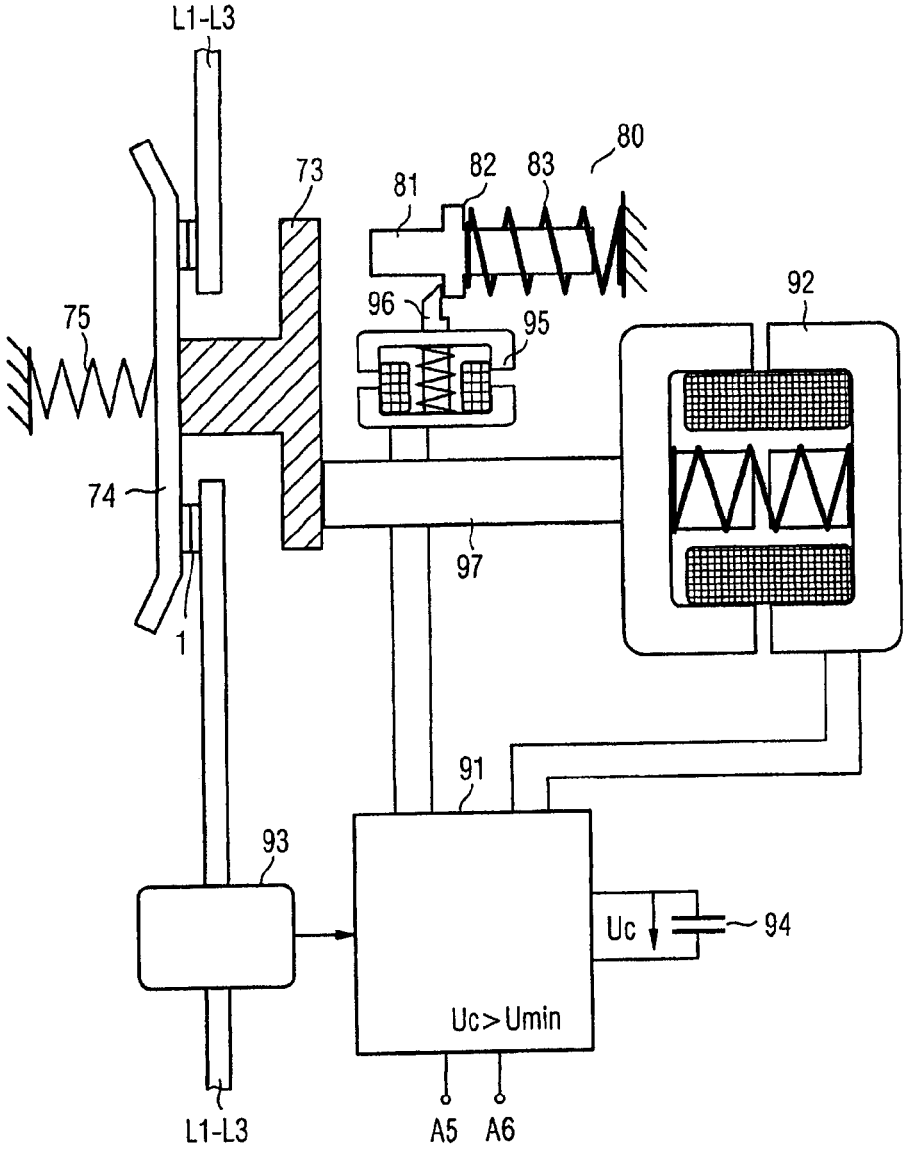
FIG. 10 shows a sixth embodiment of the apparatus according to the invention.

One particular advantage in this case is that it is possible to detect creeping wear phenomena in the drive mechanism for the electromagnetic drive 60 which then lead to switching operations becoming slower, with a reduced induced voltage $u_i$. FIG. 10 shows a sixth embodiment of the apparatus according to the invention.

The major aspect of the apparatus shown in FIG. 10 is that energy is buffered during operation, so that the electrical supply to an evaluation and control unit can still be ensured for a minimum time during disconnection and thus after the removal of the power supply, in order to allow a contact breaking-open device and/or a latching mechanism to be actuated or released, if necessary, if a main contact has become welded.

By way of example, the embodiment of the present apparatus shown in FIG. 10 relates to an electrical energy store 94 in the form of a capacitor. This capacitor is first of all charged via the control terminals A5, A6 when a supply voltage is applied to the evaluation and control unit 91. When, and only when, the energy store 94 has reached a minimum state of charge, an electromagnetic drive 92, such as a control magnet, is actuated in order to connect the main contacts 1.

In the case of a capacitor 94, the minimum state of charge of the electrical energy store 94 corresponds to a minimum charge voltage Umin for the capacitor voltage Uc. By way of example, this may be 80% of the switching voltage applied to the terminals A5, A6. The minimum state of charge of the energy store 94 is in this case designed such that it is sufficient for the evaluation and control unit 91 to initiate the contact breaking-open device 80 by way of a control signal for a release device.

When actuated, in order to connect the switching device, the illustrated control magnet 92 operates an armature 97 which is mechanically operatively connected to a contact slide 73 which in itself acts on a contact link 74. As a moving line piece, the contact link 74 then bridges the stationary line pieces of the current paths L1-L3. On connection of the control magnet 92, a contact load spring 75, which is prestressed in the disconnected state of the switching device, is unloaded and then presses the contact link 74 against the stationary line pieces of the current paths L1-L3, making contact with them. Alternatively, or additionally a latching mechanism can also be actuated in order to break open a welded main contact 1 with this latching mechanism being physically designed to allow a welded main contact 1 generally to be broken open.

Reference symbol 93 denotes means for identification of at least one welded main contact 1. According to an embodiment of the invention, the devices are used to identify whether the moving contact link 74 of the at least one main contact 1 has passed an opening point after disconnection. In the example shown in FIG. 10, the device 93 is a current sensor in particular a triple current sensor for detection of the current flow in the main current paths L1-L3 of a 3-pole switching device. In this case, the current sensor 93 is connected to the evaluation and control unit 91 via a connecting line, in order to emit a measured current value.

According to an embodiment of the invention, further operation of the switching device is interrupted if the opening-point is not passed after a predetermined time period. In the example shown in the present FIG. 10, the evaluation and control unit 91 for this purpose evaluates the current flow in the current paths L1-L3 within the predetermined time period, for example of 100 ms, after disconnection of the controller. If a current flow is detected, then the evaluation and control unit 91 emits a current pulse to the release device 95. By way of example, the release device 95 is an actuator in the form of a solenoid or plunger-type magnet, whose actuator armature 96 releases the release device 80, in the form of a spring energy store. For this purpose, the actuator armature 96 which is in the form of a blocking tooth, moves out of a restraint web 82 of a breaking-open contact slide 81 which is prestressed by a spring 83. This breaking-open contact slide 81 then strikes the contact slide 73 in order to break open the welded main contact 1.

Alternatively, the inductance of the electromagnetic drive, and therefore the OFF position of the main contacts 1 could be determined by means of measurement feedback. Alternatively, it may be possible to use an auxiliary switch, for example a mirror contact in accordance with IEC 60947-4-1, which is electrically connected to the evaluation and control unit 91 to determine whether the main contacts 1 have opened. If it is found that the main contacts 1 have not opened, then the energy store 94 is discharged via the release device 95.

Particularly stringent technical requirements relate to the reliability of the energy store after a long operating time of many years, and possibly in high ambient temperatures. It would be feasible to use capacitors which have been designed for use in the military field. These have a considerably longer life than conventional capacitors. The electrical capacitor 94 could be charged by way of a suitable charging circuit from the electrical voltage which is induced in the field coil of the control magnet 92 during the process of disconnecting the switching device. This stored electrical energy is then available for the subsequent short time interval for supplying the evaluation and control unit 91 and for initiation of the release device 95.

Instead of electrical capacitors it would also be possible to use a small flywheel, whose kinetic energy is available as electrical energy after disconnection, by way of a dynamo. Alternatively, the current transformer or transformers 93 could be made larger such that the energy which is required to operate the evaluation and control unit 91 and to initiate the release device 95 can be tapped off from the main current paths L1-L3 via the current transformers 93.

A solution would also be feasible in which the evaluation and control unit 91 has additional power supply terminals, as well as the terminals A5, A6. If the voltage is tapped off from these additional power supply terminals, then the evaluation and control unit 91 will be supplied with power from this independent power supply even after disconnection. A special latching-mechanism design is advantageous for breaking open a welding main contact 1 which has a high opening force and/or a high opening impulse in the area in which the contacts touch. An appropriate step-up transmission makes it possible for the energy which is stored in a disconnection spring not to be dissipated linearly throughout the opening movement but to be emitted predominantly over the distance from the "ON" position to the "contact touching" position. The remaining energy is then also emitted from the "contact touching" position to the "OFF" position, in order to prestress the contact load springs to the "OFF" switching position.

Figure 11:
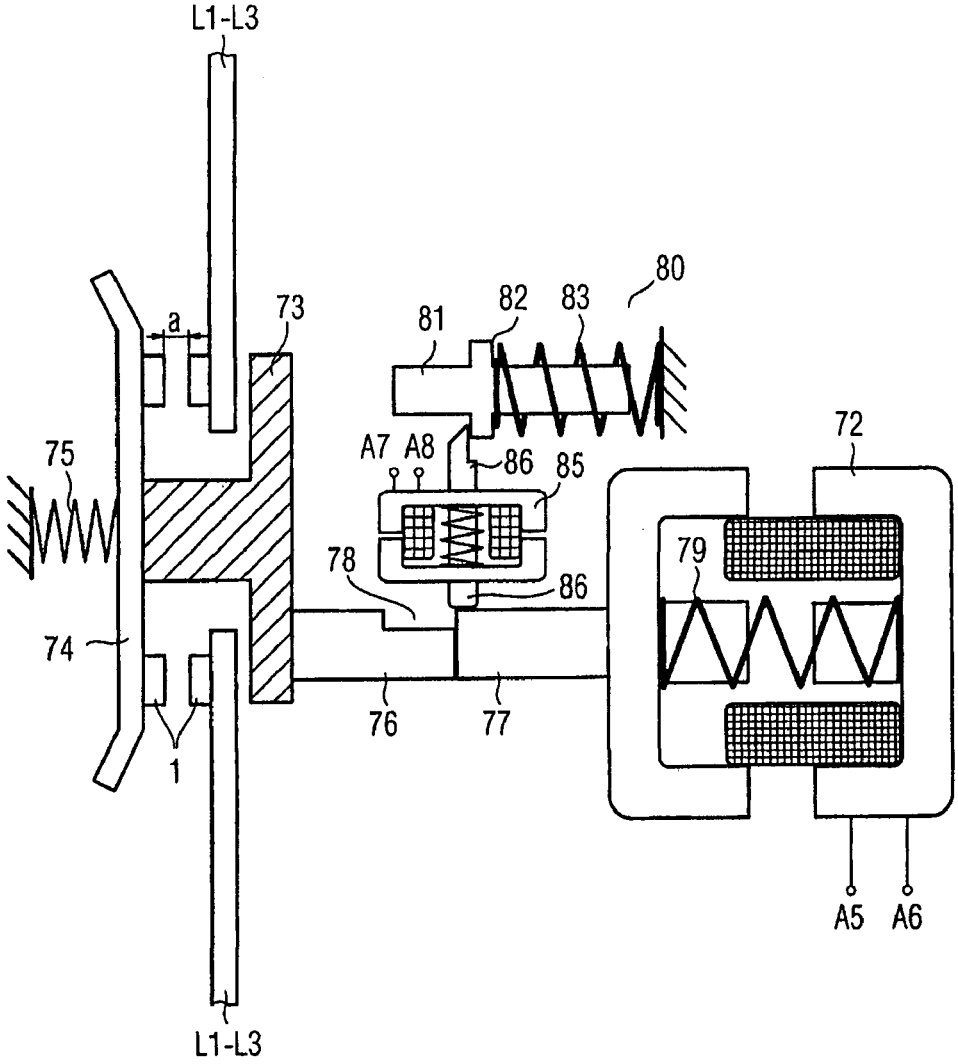
FIG. 11 shows a seventh embodiment of the apparatus according to the invention with the main contacts open.

FIG. 11 shows a seventh embodiment of the apparatus according to the invention, with open main contacts 1. It is assumed that the main contacts 1 have not yet become worn, and that they have opened correctly.

The right-hand part of the present FIG. 11 shows a control magnet 72 in the disconnected, de-energized state. In this case, the return spring 79 for the control magnet 72 forces a contact link 74 to the OFF position, via an armature 77 and via a contact slide 73 which is mechanically operatively connected. In this case, a contact load spring 75, which is weaker than that of the return spring 79, is prestressed. In the illustrated state, the main contacts 1 are now separated by a contact opening gap a. It is thus impossible for any current to flow through the current paths L1-L3.

Figure 12:
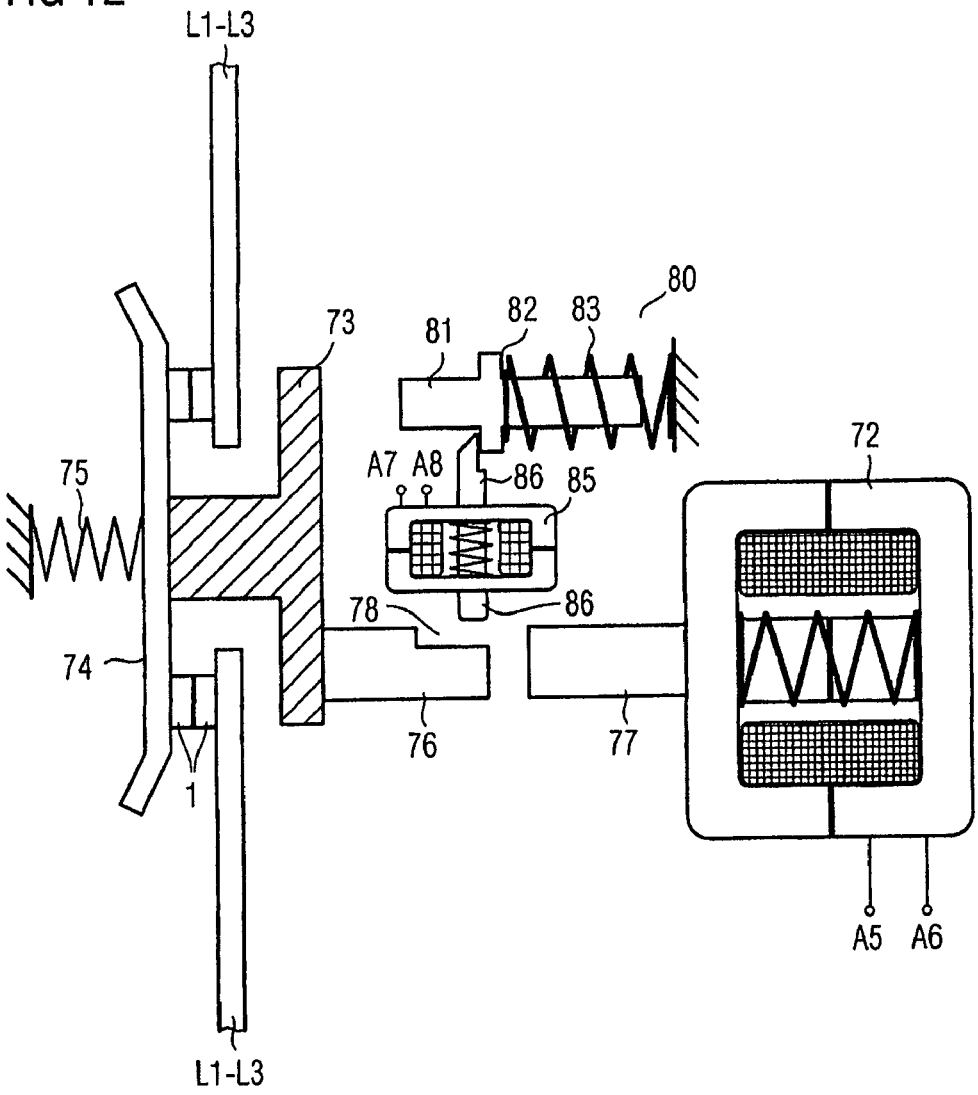
FIG. 12 shows the seventh embodiment of the apparatus according to the invention with the main contacts closed.

During disconnection, the armature 77 of the control magnet 72 is connected to a connecting piece 76, which is firmly connected to the contact slide 73. The contact slide 73 and the connecting piece 76 may also be in the form of an integral component. In the illustrated OFF state, an actuator armature 86 of a de-energized actuator 85 at the side rests on that end of the armature 77 which is opposite the control magnet 72. The actuator 85 is used as a release device for the contact breaking-open device 80. In the illustrated state, the armature 77 acts as a stop, so that the blocking tooth which is formed at the opposite end of the actuator armature 86 cannot move out of the restraint web or restraint edge 82 of the contact breaking-open device 80. A return spring for the actuator 85 is in this case still prestressed by the restraint of the stop. The physical design of the contact breaking-open device 80 in this case corresponds to that shown in FIG. 10. FIG. 12 shows the seventh embodiment of the apparatus according to the invention, with the main contacts 1 closed. In this case the field coil of the control magnet 72 is energized with current via the electrical connections A5, A6. In the example shown in FIG. 12, the armature 77 is moved to the right, removing the load from the contact slide 73. The contact link 74 now closes the main contacts 1 as a result of this load relief and the removal of the load from the prestressed contact load spring 75.

According to an embodiment of the invention, the control magnet 72 is energized during connection of the release device 85 for the contact breaking-open device 80, and at the same time or slightly afterwards. In consequence, the return spring for the release device 85 still remains and is now actively prestressed. As can be seen in comparison to FIG. 11, the return spring for the actuator 85 is now actually prestressed somewhat more. The operating delay of the control magnet 72 in comparison to the release device 85 can be provided, for example, by mechanical damping means, which act only for the connection process.

Alternatively, electrical damping means can also be used in the field circuit of the control magnet 72, for example an inductor connected in series with the field coil of the control magnet 72. The actuator armature 86 now does not release the contact breaking-open device 80 even though the stop function or restraint function is released by the operation that now takes place at the armature 77 of the control magnet 72.

As is shown in FIG. 12, if the current were to be forcibly de-energized externally the actuator armature 86 would now be moved downwards by the prestressed return spring as shown in the example in FIG. 12, thus releasing the contact breaking-open device 80. The particular advantage of this is that the contact breaking-open device 80 is initiated safely, since no energy need be buffered for initiation, or need be provided continuously. The energy which is required for initiation is stored in the already prestressed return spring of the actuator 85. The release and contact breaking-open mechanism shown in FIG. 12 is thus based on a "fail-safe" design.

As is also shown in FIG. 12, the operation of the armature 77 results in a gap of a few millimeters between it and the connecting piece 76, as a result of the switching contact 1 being in the new state. This gap decreases as the contact material wears. The connecting piece 76 is now, in the ON state, located opposite that end of the actuator armature 86 which is located opposite the blocking tooth. By way of example, the connecting piece 76 has a cutout 78 in the area of the actuator armature 86, irrespective of whether the main contacts 1 are new or have already been worn. The cutout 78 is designed such that the contact breaking-open means 80 is reliably released in the event of release of the release means 86, that is to say of the actuator which is in the form of a solenoid or plunger-type magnet. Alternatively, the connecting piece 76 could also have a constant cross-section over its entire length, corresponding to the dimensions of the connecting piece 76 in the end area.

Figure 13:
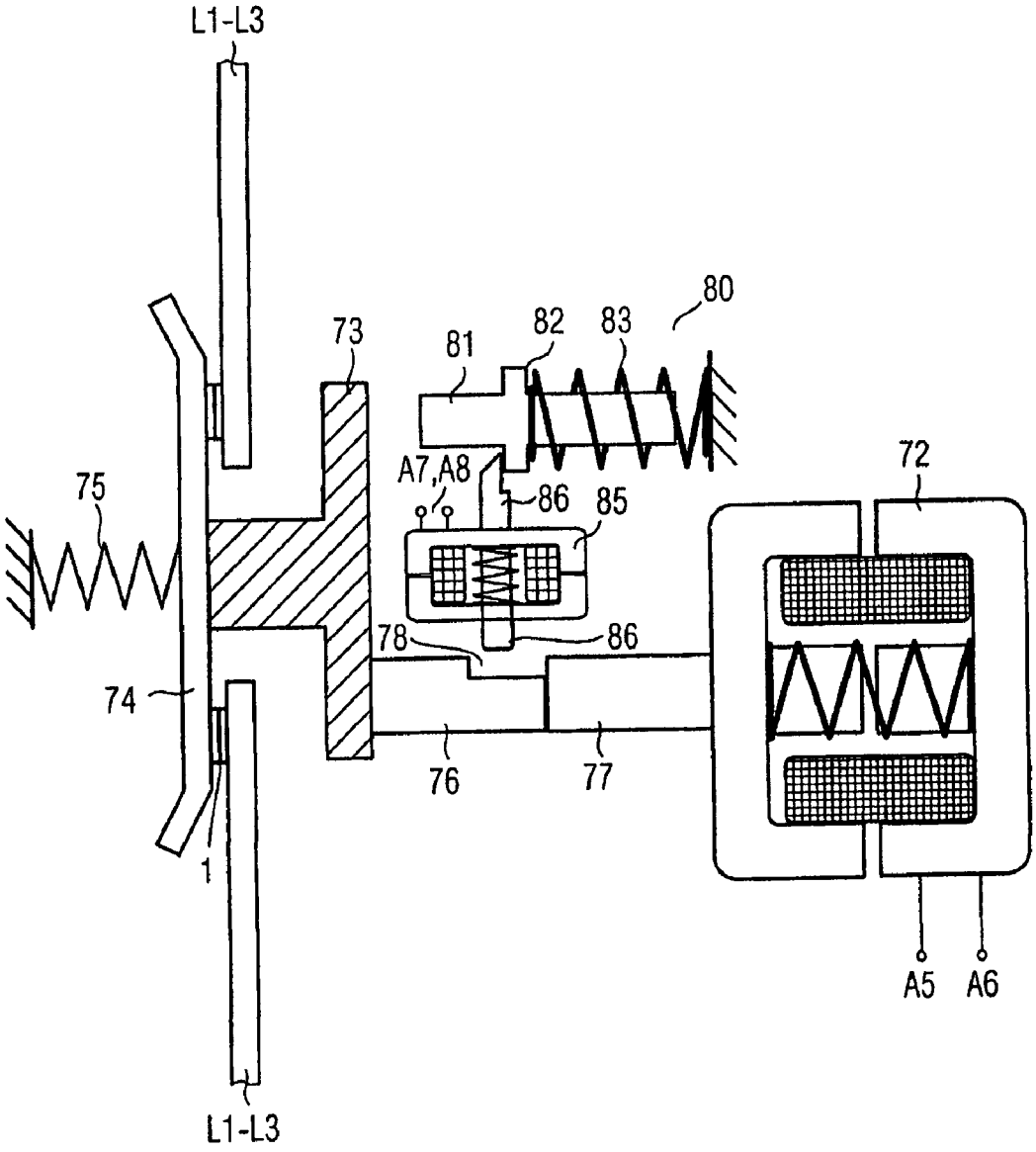
FIG. 13 shows the seventh embodiment of the apparatus according to the invention with a welded main contact and with contact breaking-open device which have not yet been released.

FIG. 13 shows the seventh embodiment of the apparatus according to the invention with a welded main contact 1, and with the contact breaking-open means 80 not yet having been released. The control device is normally disconnected by interrupting or removing the switching voltage of the terminals A5 and A6 of the control magnet 72. The switching voltage preferably also feeds the release device 85 via the terminals A7 and A8, so that this is also released once the switching voltage is removed. The field circuits of the control magnet 72 and of the release means 85 can also be connected in series. According to an embodiment of the invention, the switching device now determines or checks whether the moving contact link 74 of the at least one main contact 1 has passed an opening point after disconnection. As is shown in FIG. 13, the main contacts 1 were now no longer opened because they had become welded, so that the opening point is not passed even after a predetermined time period. By way of example, the predetermined time period may be 100 ms. The release device 85 is preferably released during disconnection with a delay with respect to the control magnet 72, so that the armature 77 can once again assume the stop and restraint function for the actuator armature 86 during disconnection. Further operation of the switching device is interrupted after the predetermined time period has elapsed, if the armature 77 can no longer be operated because the main contact 1 has become welded, so that it could still "catch" the already released actuator armature 86. The release device 85 is now released completely thus releasing the contact breaking-open device 80.

The release delay during disconnection of the actuator 85 may be produced, for example, by way of mechanical damping systems or by way of an electrical freewheeling circuit with a freewheeling diode in the field circuit of the actuator 85. In this case, the freewheeling circuit maintains the magnetization of the magnetic circuit for the actuator 85 for the predetermined time period as well. By contrast, during disconnection, the field circuit of the control magnet 72 can be electrically damped by way of a relatively high-value resistance, so that the magnetic energy in the magnetic circuit of the control magnet 72 can be dissipated very quickly.

Figure 14:
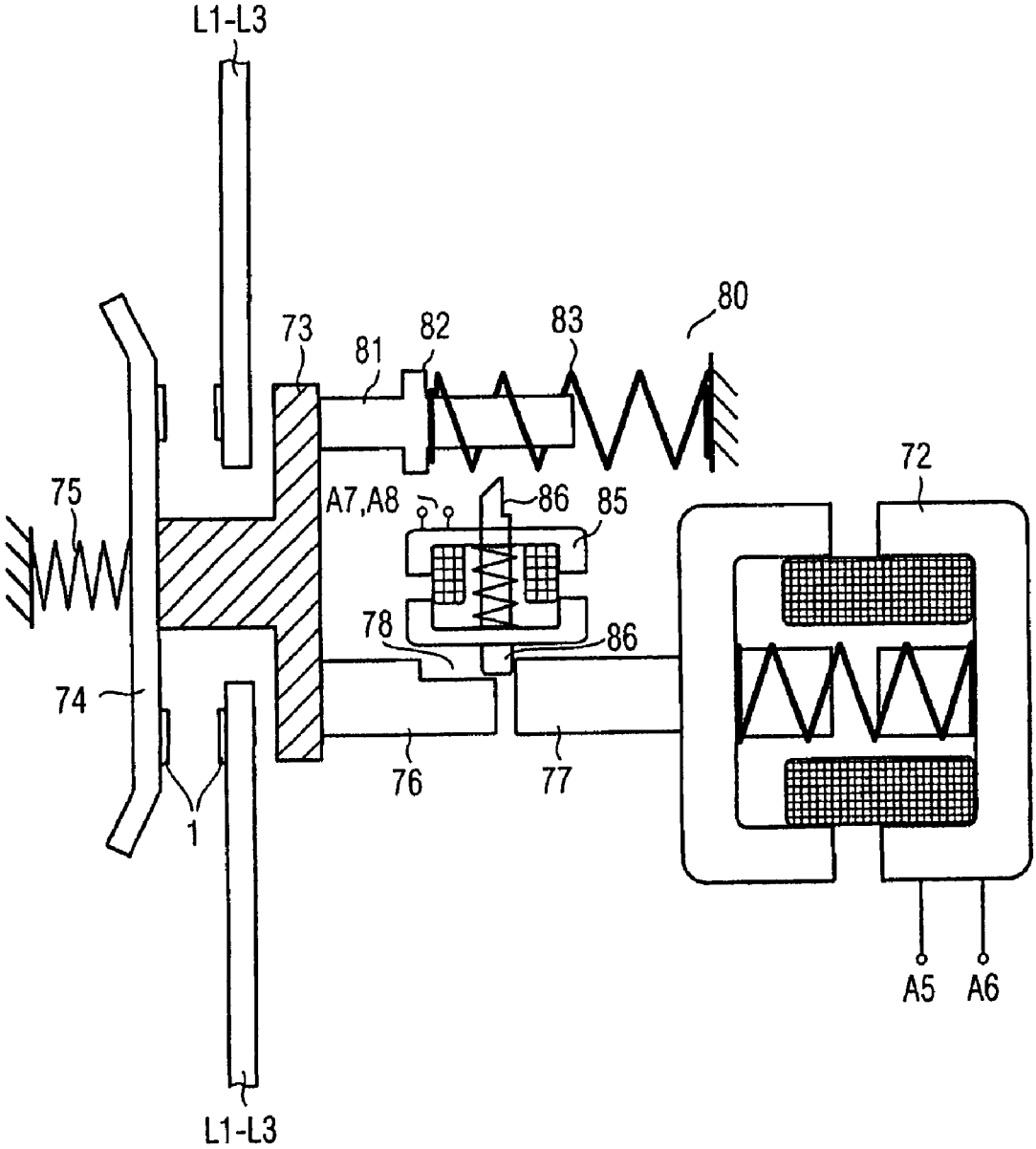
FIG. 14 shows the seventh embodiment of the apparatus according to the invention with the main contact having been broken open by way of the contact breaking-open device having been released.

FIG. 14 shows the seventh embodiment of the apparatus according to the invention with the main contact 1 having been broken open by way of the released contact breaking-open device. As described above, the spring force of the spring of the contact breaking-open device 80 is designed such that, in addition to providing the required breaking-open force, this can also overcome the spring force, in the opposite direction, of the contact load spring 75. Reclosing of the main contact 1 is therefore no longer possible. Operation of the switching device therefore remains interrupted. The contact breaking-open device 80 may also have a mechanism which is not illustrated but allows the released spring 83 and the release device 85 to be loaded again. By way of example, this resetting of the mechanism can be carried out manually.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A method for safe operation of a switching device including at least one connectable/disconnectable main contact, a moving contact link, and at least one control magnet including a moving armature, the armature acting on the contact link during connection and disconnection such that the corresponding main contact is closed and opened, the method comprising:

identifying whether the moving contact link of the at least one main contact has passed beyond an opening point after disconnection; and interrupting further operation of the switching device if the moving contact link has not passed beyond the opening point after disconnection after a time period, where the interrupting includes opening the main contacts beyond the opening point, wherein when the control magnet is in the connected state, a release device is actively held in an energized state to prevent the initiation of a contact breaking-open device, and during disconnection, the release device and the control magnet are de-energized with an armature or a component of the control magnet which is mechanically operatively connected to the armature, preventing the initiation of the release device.

2. The method as claimed in claim 1, wherein that the opening point has been passed is identified by measuring a current in a current path to be switched by the main contact, where the opening point is identified as not having been passed if the measured current is greater than the intended current after disconnection.

3. The method as claimed in claim 1, wherein that the opening point has been passed is identified by measuring a voltage drop across a main contact, where the opening point is identified as not having been passed if the voltage drop is less than the intended voltage drop after disconnection.

4. The method as claimed in claim 1, wherein that the opening point has been passed is identified by measuring an inductance of the control magnet, where the opening point is identified as not having been passed if the inductance after disconnection has a value which does not correspond to the intended value after opening.

5. The method as claimed in claim 1, wherein the opening point is identified by a current state of at least one device operatively connected to the contact link, where upon the identified opening point not having been passed, the at least one device remains in a first state, which does not correspond to a second state after opening, after disconnection.

6. The method as claimed in claim 5, wherein, an auxiliary contact is closed on connection or for connection of a control magnet, a break contact is opened on connection of the control magnet, and the release device, connected in series with the auxiliary and break contacts, initiates a contact breaking-open device if the auxiliary contact at least one of remains and has remained in the closed state on disconnection.

7. The method as claimed in claim 6, wherein the auxiliary and break contacts are designed such that, during connection, the auxiliary contact closes after the break contact has opened, and such that, during disconnection, the break contact closes after the auxiliary contact has opened.

8. The method as claimed in claim 5, wherein an auxiliary contact is opened during connection or for connection of a control magnet, a make contact is closed during connection of the control magnet, and a release device initiates a contact breaking-open device if the auxiliary contact remains, or has remained, in the open state during disconnection, and the respective opened switching state of the auxiliary and make contacts is evaluated.

9. The method as claimed in claim 8, wherein the auxiliary and make contacts are designed such that, during connection, the auxiliary contact opens after the make contact has closed, and such that, during disconnection, the make contact opens after the auxiliary contact has closed.

10. The method as claimed in claim 1, wherein, during a switching operation, any magnetic flux change in a magnetic circuit of the control magnet is measured, with the opening point being passed over when, during disconnection of the control magnet, the magnetic flux change has exceeded a comparison value.

11. The method as claimed in claim 10, wherein the magnetic flux change is measured by an induction coil.

12. The method as claimed in claim 1, wherein an electrical supply for an evaluation and control unit for the switching device is maintained by an electrical energy-storage element for a minimum time, in order to identify by measurement the presence of a welded main contact and in order, if necessary, to at least one of actuate and release at least one of a contact-breaking open device and a latching mechanism.

13. The method as claimed in claim 12, wherein, upon receiving a switching command, the control magnet is energized to operate at least one main contact only once the electrical-energy storage element has reached a minimum state of charge.

14. The method as claimed in claim 1, wherein, during connection, the release device is energized before the control magnet and, during disconnection, the control magnet is de-energized before the release device.

15. The method as claimed in claim 1, wherein the release device is a solenoid or a plunger-type magnet.

16. The method as claimed in claim 1, wherein the contact breaking-open device includes a spring energy store.

17. The method as claimed in claim 1, wherein the interrupting further interrupts by opening a switching element which is arranged in series with the main contact in the current path.

18. The method as claimed in claim 1, wherein the interrupting further interrupts by interrupting at least one control line for controlling the control magnet.

19. An apparatus for safe operation of a switching device, the switching device including at least one connectable/disconnectable main contact, a moving contact link, and at least one control magnet including a moving armature to act on the contact link during connection and disconnection such that the corresponding main contact can be closed and opened, the apparatus comprising:

first means for identifying whether the moving contact link of the at least one main contact has passed beyond an opening point after disconnection; and further means for interrupting further operation of the switching device if, after disconnection, the first means identifies that the moving contact link has not passed beyond the opening point after a time period, where the further means for interrupting includes opening the main contacts beyond the opening point, wherein release means is provided, which is actively held in an energized state when the control magnet is in the connected state, for preventing initiation of a contact breaking-open device, and the release means and the control magnet are dc-energized during disconnection, with an armature or a component of the control magnet which is mechanically operatively connected to the armature preventing the initiation of the release means in this case.

20. The apparatus as claimed in claim 19, wherein the first means includes a current sensor which measures the current in a current path to be switched by the main contact.

21. The apparatus as claimed in claim 19, wherein the first means includes two electrodes, with a first and a second electrode being arranged such that any voltage drop across the main contact is able to be dissipated.

22. The apparatus as claimed in claim 19, wherein the first means includes means for detection of an inductance that measures the inductance of the control magnet.

23. The apparatus as claimed in claim 19, wherein the first means includes an opening mechanism, operatively connected to the contact link and able to assume first and second states.

24. The apparatus as claimed in claim 23, wherein an auxiliary contact is provided, which at least one of closes during connection of the control magnet and is closed for connection of the control magnet, a break contact is provided and is designed to be opened on connection of the control magnet, and the release means is provided, connected in series with the auxiliary and break contacts, for initiating a contact breaking-open device if the auxiliary contact remains, or has remained in the closed state during disconnection.

25. The apparatus as claimed in claim 24, wherein the auxiliary and break contacts are designed such that, during connection, the auxiliary contact closes after the break contact is opened, and such that, during disconnection, the break contact closes after the auxiliary contact has opened.

26. The apparatus as claimed in claim 23, wherein an auxiliary contact is provided, which at least one of opens on connection of the control magnet and is opened for connection of the control magnet, a make contact is provided and is designed to be closed on connection of the control magnet, the release means is provided, for initiating a contact breaking-open device if the auxiliary contact remains, or has remained in the open state during disconnection, and evaluation means for evaluating the respectively open switching state of the auxiliary and make contacts.

27. The apparatus as claimed in claim 26, wherein the auxiliary and make contacts are designed such that, during connection, the auxiliary contact opens, after the make contact has closed and in that during disconnection, the make contact opens after the auxiliary contact has closed.

28. The apparatus as claimed in claim 19, wherein means is provided for detecting any magnetic flux change in a magnetic circuit of the control magnet during a switching operation with the opening point having been passed when the magnetic flux change has exceeded a comparison value on disconnection of the control magnet.

29. The apparatus as claimed in claim 28, wherein the magnetic flux change is measured by an induction coil.

30. The apparatus as claimed in claim 19, wherein an electrical energy-storage element is provided to maintain the electrical supply for an evaluation and control unit for the switching device for a minimum time, to detect, by measurement, the presence of a welded main contact and, if required to at least one of actuate and release at least one of a contact breaking-open device and a latching mechanism.

31. The apparatus as claimed in claim 30, wherein means are provided for energizing the control magnet when a switching command has occurred for operation of at least one main contact only when the electrical energy-storage element has reached a minimum state of charge.

32. The apparatus as claimed in claim 19, wherein means are provided for de-energizing the release means before de-energizing of the control magnet during connection and for de-energizing the control magnet at a time before the release means is de-energized, during disconnection.

33. The apparatus as claimed in claim 19, wherein the release means is at least one of a solenoid and plunger-type magnet.

34. The apparatus as claimed in claim 19, wherein the contact breaking-open device has a spring energy store.

35. The apparatus as claimed in claim 19, wherein the further means includes an evaluation device to open a switching element, arranged in series with the main contact in the current path, to interrupt further operation.

36. The apparatus as claimed in claim 19, wherein the further means includes a control device to control the control magnet, where the control device interrupts a control line to the control magnet to interrupt further operation.

37. A switching device to carry out the method as claimed in claim 1 for safe switching of loads, the switching device being at least one of a contactor, a circuit breaker and a compact outgoer.

38. A switching device for safe switching of loads having an apparatus as claimed in claim 19, the switching device being at least one of a contactor, a circuit breaker and a compact outgoer.

39. The switching device as claimed in claim 37, wherein the switching device is a three-pole switching device having three main contacts for connection and disconnection of three current paths with a control magnet.

40. The method as claimed in claim 14, wherein the release device is a solenoid or a plunger-type magnet.

41. The method as claimed in claim 14, wherein the contact breaking-open device includes a spring energy store.

42. The apparatus as claimed in claim 32, wherein the release means is at least one of a solenoid and plunger-type magnet.

43. The apparatus as claimed in claim 32, wherein the contact breaking-open device has a spring energy store.

44. The switching device as claimed in claim 37, wherein the switching device is a three-pole switching device having three main contacts for connection and disconnection of three current paths with a control magnet.

* * * * *